US009962749B2

(12) United States Patent
Morgan et al.

(10) Patent No.: US 9,962,749 B2
(45) Date of Patent: May 8, 2018

(54) PRESS BRAKE TOOL SAFETY LATCH MECHANISM

(71) Applicant: MATE PRECISION TOOLING, INC., Anoka, MN (US)

(72) Inventors: Christopher Morgan, Minneapolis, MN (US); Joseph C. Schneider, Elk River, MN (US)

(73) Assignee: MATE PRECISION TOOLING, INC., Anoka, MN (US)

( * ) Notice: Subject to any disclaimer, the term of this patent is extended or adjusted under 35 U.S.C. 154(b) by 2 days.

(21) Appl. No.: 15/274,596

(22) Filed: Sep. 23, 2016

(65) Prior Publication Data

US 2018/0085807 A1 Mar. 29, 2018

(51) Int. Cl.
*B21D 37/04* (2006.01)
*B21D 5/02* (2006.01)

(52) U.S. Cl.
CPC ..... *B21D 5/0236* (2013.01); *B21D 5/0209* (2013.01); *B21D 37/04* (2013.01)

(58) Field of Classification Search
CPC ..... B21D 5/0209; B21D 5/0236; B21D 37/04
USPC ..... 72/482.91
See application file for complete search history.

(56) References Cited

U.S. PATENT DOCUMENTS 5,245,854 A 9/1993 Bruggink et al.
6,138,492 A * 10/2000 Vining ..... B21D 5/0209 72/389.3
6,467,327 B1 10/2002 Runk et al.
6,606,896 B2 * 8/2003 Tarasconi ..... B21D 5/0209 72/462
6,732,564 B2 5/2004 Runk et al.
6,928,852 B2 8/2005 Enderink
7,004,008 B2 2/2006 Harrington et al.
7,021,116 B2 4/2006 Harrington et al.
7,096,708 B2 * 8/2006 Gascoin ..... B21D 5/0209 72/481.1
7,194,820 B2 3/2007 Schweiger et al.
7,484,312 B2 2/2009 Morgan
7,632,224 B2 * 12/2009 Rouweler ..... B23Q 3/1556 294/94
7,634,935 B2 * 12/2009 Mazzocchi ..... B21D 5/0209 72/389.3

(Continued)

FOREIGN PATENT DOCUMENTS

EP 1862233 A1 12/2007
WO 0030781 A1 6/2000
WO 2013116886 A1 8/2013

OTHER PUBLICATIONS

International Search Report and Written Opinion of the International Searching Authority for International Patent Application No. PCT/US2017/052987, dated Dec. 18, 2017 (11 pages).

*Primary Examiner* — David B Jones
(74) *Attorney, Agent, or Firm* — Dorsey & Whitney LLP

(57) ABSTRACT

A press brake tool or similar machine component includes a tool body with a first end configured for operation on a workpiece and a second end configured for coupling the tool with a tool holder in a press brake or related machine tool apparatus. A latch mechanism is provided in the second end, with an actuator configured to rotate the latch mechanism into first and second positions, respectively, for selective engagement and disengagement of the tool with the tool holder.

22 Claims, 22 Drawing Sheets

(56) References Cited

U.S. PATENT DOCUMENTS

| | | | | |
|---|---|---|---|---|
| 7,661,288 | B2 | 2/2010 | Shimota et al. | |
| 7,810,369 | B2 | 10/2010 | Rouweler et al. | |
| 8,099,992 | B2 * | 1/2012 | Rouweler | B21D 5/0209 72/389.3 |
| 8,327,745 | B2 | 12/2012 | Lee et al. | |
| 8,408,111 | B2 | 4/2013 | Johnston et al. | |
| 8,943,870 | B2 * | 2/2015 | Rouweler | B21D 5/0209 72/481.1 |
| 9,254,517 | B2 * | 2/2016 | Sato | B21D 5/0236 |
| 2002/0166360 | A1 * | 11/2002 | Runk | B21D 5/0209 72/481.1 |
| 2004/0103710 | A1 * | 6/2004 | Gascoin | B21D 5/0209 72/482.2 |
| 2015/0306651 | A1 | 10/2015 | Rogers et al. | |

* cited by examiner

PRESS BRAKE TOOL SAFETY LATCH MECHANISM

BACKGROUND

Press brake assemblies commonly include an upper table and a lower table. The upper table may be equipped to move vertically with respect to the lower table. Various forming tools may be mounted to the tables such that when the tables are brought together, the tools may bend or impress a workpiece, such as a piece of sheet metal, placed therebetween. Typically, the upper table will couple with male forming tools, such as press brake and punch tools, and the bottom table will couple with female forming tools, such as dies. In order to perform a variety of forming operations, differently shaped forming tools must be used. Thus, it is often necessary to exchange various forming tools within both the upper table and lower table.

Because the forming tools mounted in the lower table are supported from below, they may be substituted with relative ease. The forming tools mounted to the upper table, however, are suspended from above, usually held in place by a clamping mechanism that clamps all of the forming tools simultaneously. Upon loosening, unlocking, or releasing the clamping mechanism, the forming tools mounted to the upper table may be removed by sliding the tools horizontally to an open end of the upper table, or in some instances, by removing the tools vertically. Horizontal exchange of the forming tools can be cumbersome due to the proximity of the forming tools with respect to one another in the upper table, often necessitating the removal of each tool mounted within the upper table when only one tool is being exchanged. Neighboring clamps may also interfere with horizontal removal of the tools.

Vertical removal and insertion of the forming tools may not improve the exchange process due to the safety risks associated with handling the often heavy forming tools. In particular, loosening the clamping mechanism of the upper table may result in one or more tools falling and injuring a press brake operator.

To prevent the forming tools from accidentally falling from the upper table of a press brake assembly, several safety mechanisms have been developed. One such mechanism may involve a safety tang that protrudes laterally from a surface of the forming tool. Such a safety tang may be shifted into a complementary groove defined by a tool holder in the upper table, thereby securing the tool to the holder until the tool is clamped. This mechanism is problematic, however, because of the manipulation required of the operator to actuate the safety mechanism, which is often concealed by the holder, and therefore inaccessible to the operator. Securing such tools within an unclamped holder remains difficult and unsafe.

Thus, there exists a need for improved mechanisms used to secure forming tools to the upper table of a press brake assembly or similar apparatus while the clamping mechanism of such an assembly is disengaged, such that heavy forming tools can be quickly exchanged without the risk of accidentally falling.

SUMMARY

A tool includes a safety mechanism for operation in a press brake or similar machine apparatus. The mechanism includes a latch assembly configured to provide a releasable coupling between the tool and a tool holder. A rotary switch is provided to selectively engage and disengage the coupling with the tool holder, alternately coupling and releasing the tool from the press assembly.

DETAILED DESCRIPTION

Figure 1A:
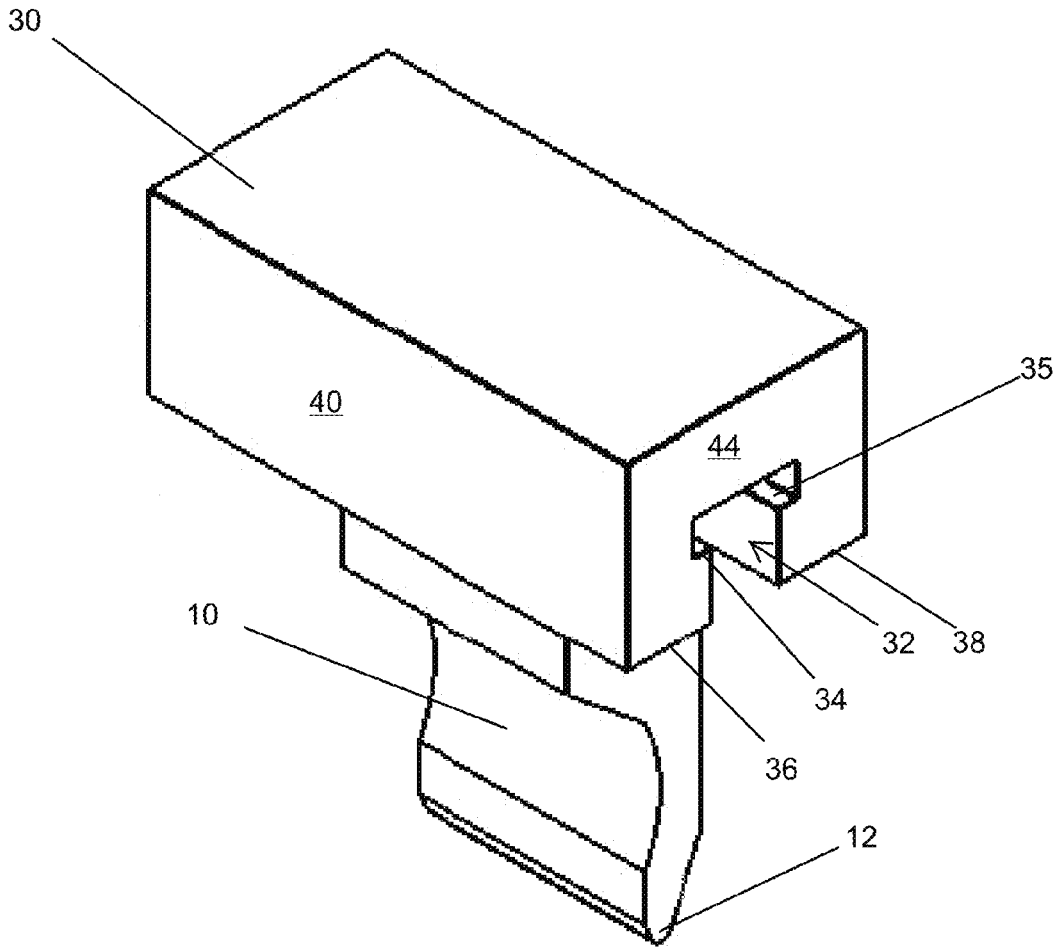
FIG. 1A is an isometric view of a tool coupled with a tool holder for a press brake or similar machine apparatus.

FIG. 1A is an isometric view of a tool component 10 coupled with a tool holder 30 in a press brake apparatus. While generally described as a press brake tool herein, component 10 may alternatively be configured as a press brake punch, folding press, punch tool, or similar machine tool component.

As illustrated in FIG. 1A, holder 30 may define a receiving cavity 32 exposed at holder side surface 44. Tool 10 may be coupled with holder 30 by inserting an upper portion of tool 10 into receiving cavity 32, where at least one relief, groove, recess, shelf or ledge 34 and/or 35 provides a surface for mounting tool 10. As further shown, holder 30 may include two receiving shoulders 36, 38 oriented perpendicularly to front holder surface 40. Tool 10 includes a tool end or working end 12 opposite holder 30. In operation, such a press brake assembly may punch, impress, crimp, fold, crease, or otherwise shape various workpieces inserted beneath working end 12 and optionally one or more forming dies. In embodiments, a workpiece may include a sheet material component or other material to be tooled.

Figure 1B:
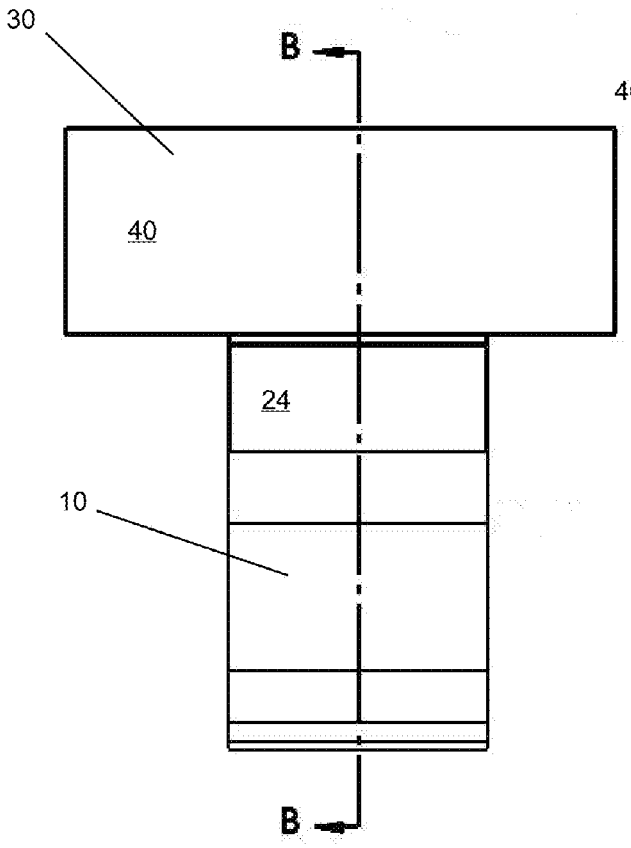
FIG. 1B is a front view of the tool coupled to the holder.

FIG. 1B is a front view of tool 10 coupled to holder 30. As illustrated in FIG. 1B, front tool surface 24 may remain exposed upon insertion of tool 10 into holder 30. In the example shown, neither front holder surface 40 nor front tool surface 24 includes a mechanism or access point for adjusting the coupling of tool 10 with holder 30. The mechanism by which tool 10 is coupled with holder 30 is unexposed at the front of tool 10 and holder 30.

Figure 1C:
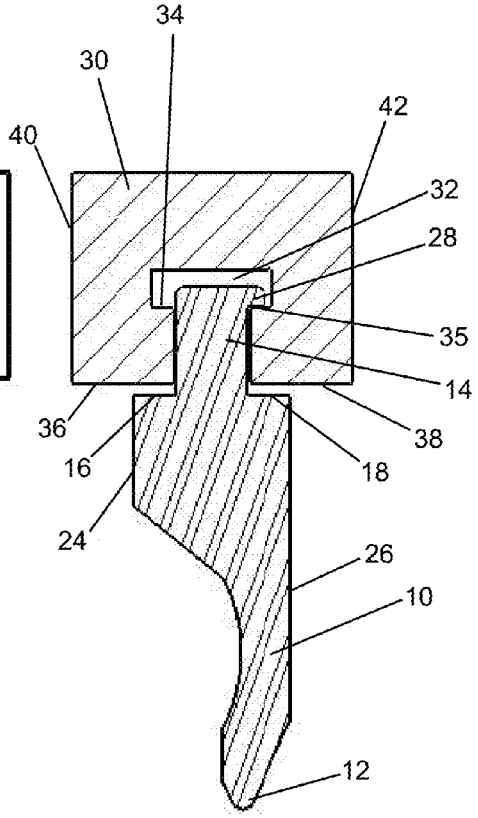
FIG. 1C is a section view of the tool coupled to the holder, taken along line B-B of FIG. 1B.

FIG. 1C is a section view of tool 10, taken along line B-B of FIG. 1B. This section view illustrates the inner portion of tool 10 and holder 30. As shown, tool 10 includes a top end or tang 14 inserted within receiving cavity 32. A lateral protrusion 28 extends laterally outward from the top of tang 14, supported on shelf or ledge 35 of holder 30. Lateral protrusion 28 may be fixed or stationary, such that once tool 10 is inserted into holder 30, tool 10 remains secured therein via protrusion 28 resting on ledge 35.

As further illustrated in FIG. 1C, two shoulder portions 16, 18 may extend horizontally outward from the base of tang 14, the shoulder portions aligning with complementary receiving shoulders 36, 38 on the bottom of holder 30. FIG. 1C also depicts rear tool surface 26 opposite front tool surface 24, and rear holder surface 42 opposite front tool surface 40.

Figure 1D:
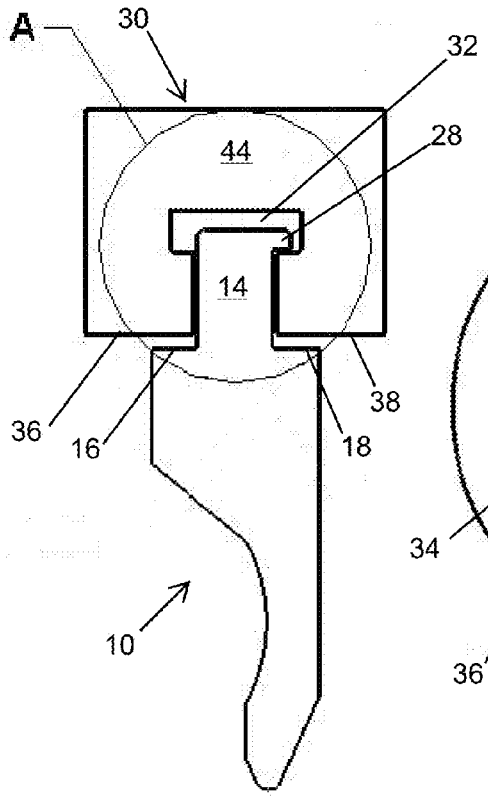
FIG. 1D is a side view of the tool coupled to the tool holder.

FIG. 1D is a side view of tool 10 coupled to holder 30. As shown, receiving cavity 32 may be exposed at holder side surface 44. Because protrusion 28 may prevent vertical insertion and removal of tool 10 with respect to receiving cavity 32, tang 14 and protrusion 28 may be slidably inserted into and removed from receiving cavity 32 in a lateral direction at one or both ends, such as side surface 44.

Figure 1E:
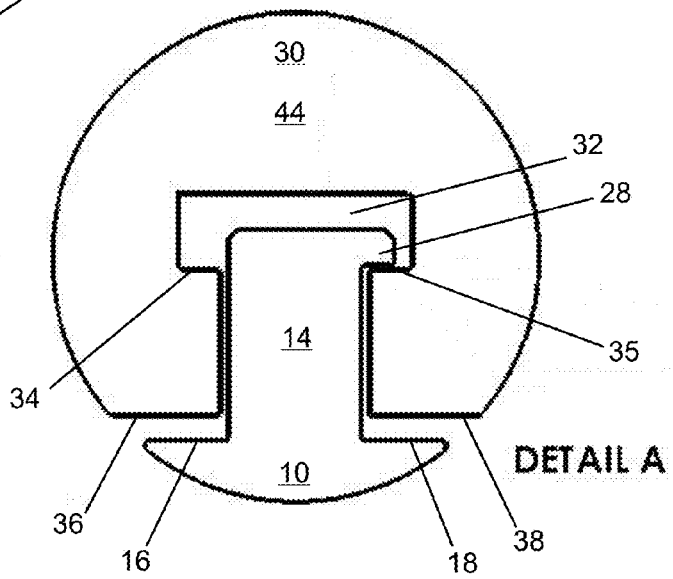
FIG. 1E is a detail view of the tool and the holder, taken at detail A of FIG. 1D.

FIG. 1E is a detail view of tool 10 and holder 30, taken at detail A of FIG. 1D. As more closely shown in FIG. 1E, protrusion 28 may be formed integrally with tang 14. The length of protrusion 28 may vary and may depend on the size and/or weight of tool 10. For example, larger and/or heavier tools may necessitate a longer protrusion to adequately secure tool 10 within holder 30. The dimensions of receiving cavity 32 may also vary. In embodiments, the wider portion of receiving cavity 32, defined laterally by ledges 34 and 35, may be larger to facilitate manual insertion and removal of tool 10 with respect to holder 30.

Figure 2A:
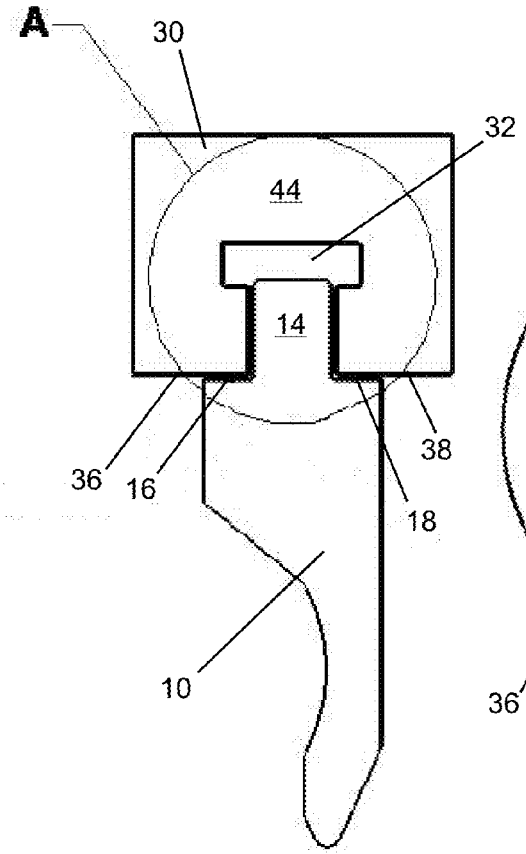
FIG. 2A is a side view of a tool coupled to a tool holder for a press brake or similar machine apparatus.

FIG. 2A is a side view of tool 10 and holder 30. As shown in FIG. 2A, tang 14 may not include a lateral protrusion for securing tool 10 within holder 30.

Figure 2B:
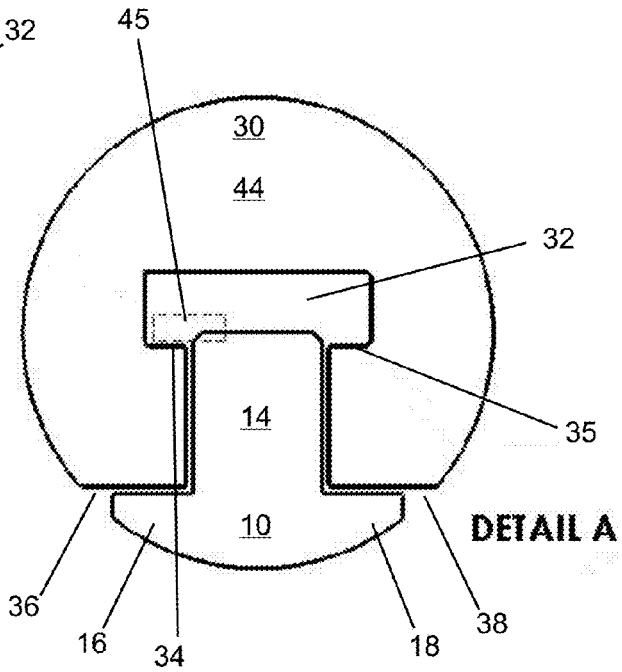
FIG. 2B is a detail view of the tool and the holder, taken at detail A of FIG. 2A.

FIG. 2B is a detail view of tool 10 and holder 30, taken at detail A of FIG. 2A. As shown in FIG. 2B, tang 14 may include latch member 45. In embodiments, latch member 45 may extend laterally outward from tang 14 within receiving cavity 32, where it may engage with ledge 34 of holder 30. In some examples, latch member 45 may be movable such that tool 10 may be releasably secured within holder 30. In embodiments, latch member 45 may be movable such that in an unlocked position, latch member 45 does not protrude laterally from tang 45, thereby allowing vertical insertion and removal of tool 10 with respect to holder 30.

Figure 3A:
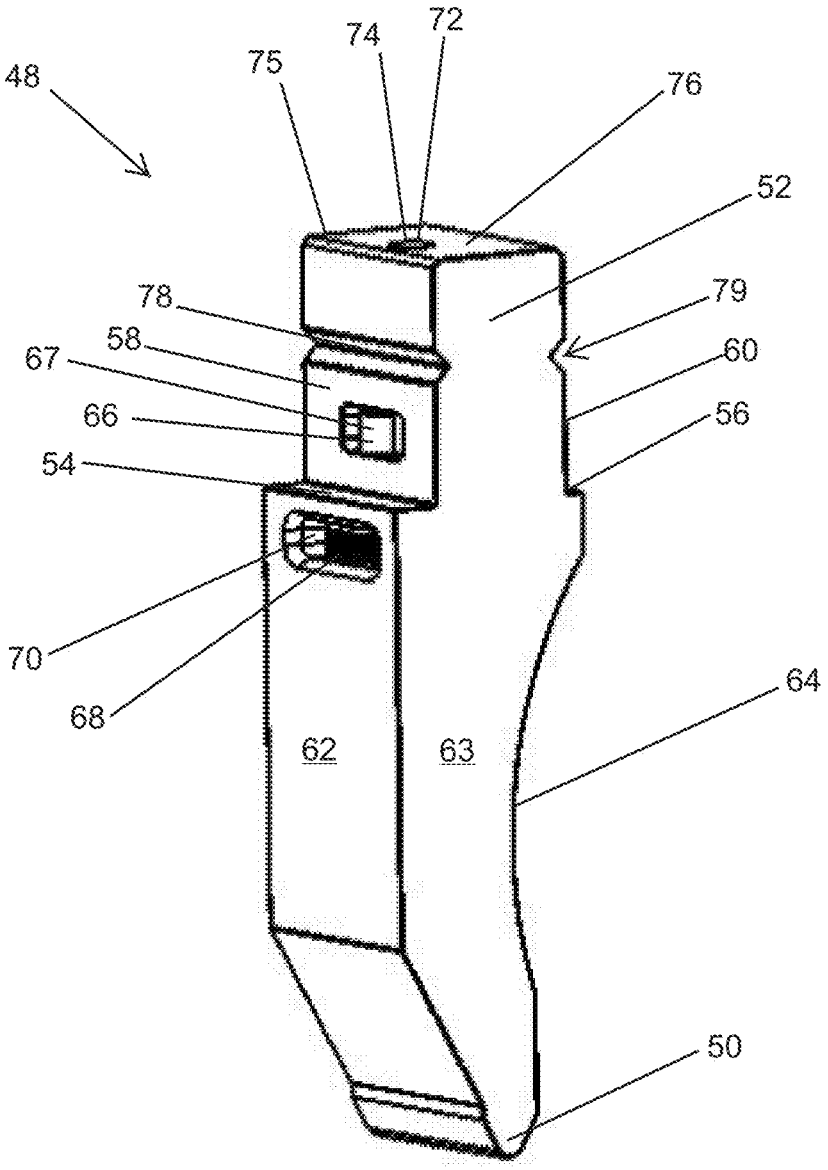
FIG. 3A is an isometric view of a tool for a press brake or similar machine apparatus, showing a rotatable latch and an actuator mechanism in an engaged configuration.

FIG. 3A is an isometric view of a tool or tool body 48 for a press brake or similar machine apparatus, showing a rotatable latch, cam or key 66 and a handle, knob, lever or other actuation member 68. Tool 48 is shown in FIG. 3A in a locked configuration, in which a locking protrusion, tab, lobe or flange 67 on latch 66 protrudes laterally outward from face 58 of tang 52, disposed on the first (top) end of tool 48. Tool 48 may include front surface 62, rear surface 64, and working end 50 opposite tang 52. Tang 52 includes two reference faces 58, 60 which each define an inwardly extending groove 78, 79 (e.g., on front face 58 and rear face 60, respectively). From the base of tang 52, two shoulder portions 54, 56 extend horizontally outward. In this example, an opening 72 defined by top surface 76 exposes shank or shaft 74. Alternatively, shaft 74 may be disposed within top surface 76.

As illustrated in FIG. 3A, actuation member (or actuator) 68 may be exposed and accessible at front surface 62 of tool (or tool body) 48 through an access window or opening 70. Actuator 68 may comprise a latch, handle, knob, lever, protrusion, or any other feature manipulable or graspable by an operator for manual operation of latch 66 to selectively engage and disengage tool 48 from a tool holder or similar apparatus. Actuator 68 may be operatively coupled with rotatable latch 66 such that moving, rotating, or otherwise adjusting actuator 68 may cause rotatable latch 66 to rotate. Together, actuator 68 and rotatable latch 66 may comprise a locking assembly used to at least temporarily couple tool 48 with a tool holder prior to clamping tool 48 with the holder. In contrast to sliding laterally in straight-line direction, rotation of rotatable latch 66 may cause locking protrusion 67 to rotate inwardly or outwardly with respect to reference face 58. When protruding outwardly, as depicted in FIG. 3A, locking protrusion 67 may extend within a receiving cavity of a tool holder, resting on a shelf or ledge portion therein, such as one or more of ledges 34, 35 depicted within receiving cavity 32 in FIGS. 1 and 2. Accordingly, rotatable latch 66 may reversibly lock tool 48 into a corresponding tool holder upon manipulation of actuator 68. To enable manual manipulation of actuator 68 when tang 52 is inserted within a tool holder, actuator 68 may be positioned below tang 52, and thus a tool holder coupled thereto, and accessible to one or more machine operators through access window 70.

In the particular embodiment shown in FIG. 3A, rotatable latch 66 is positioned within tang 52, exposed at reference face 58. Because tang 52 may comprise the only portion of tool 48 inserted into a complementary tool holder, positioning rotatable latch 66 within, on top of, or otherwise attached or coupled to tang 52 enables rotatable latch 66 to engage with a receiving cavity defined by the tool holder. As shown in other exemplary embodiments disclosed herein, the specific position of rotatable latch 66 may vary and may depend at least in part on the particular style and/or size of the tool and/or tool holder being used, as well as the overall configuration of the press brake assembly, for instance.

The size and/or shape of rotatable latch 66 may also vary. In embodiments, rotatable latch 66 may comprise a rotary cam or pawl. Rotatable latch 66 may comprise one unitary component, or multiple coupled components. In some examples, rotatable latch 66 may comprise an irregular shape defining one or more lobes or protrusions 67. Rotatable latch 66 and/or any protrusions thereon may include, in some embodiments, one or more beveled surfaces to facilitate insertion of tang 52 into a receiving cavity of a tool holder. According to such embodiments, tool 48 may be snap-locked within a complementary tool holder.

As further illustrated in FIG. 3A, tool 48 may also include one or more beveled surfaces, such as beveled surface 75. At least one of such beveled surfaces may facilitate insertion of tool 48 into a complementary tool holder. Grooves 78, 79 may be necessary to accommodate complementary protrusions or rails within a tool holder.

Figure 3B:
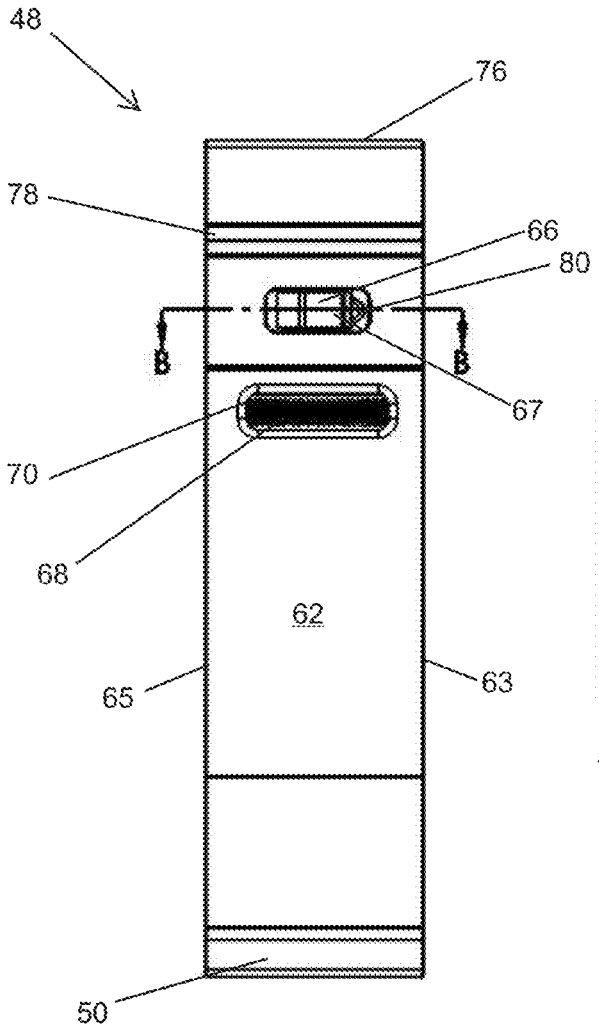
FIG. 3B is a front view of the tool in FIG. 3A.

FIG. 3B is a front view of tool 48. As shown, access window or opening 70 and actuator mechanism 68 may be approximately centered, horizontally, at front face 62. As further depicted, locking protrusion 67 may be horizontally offset in the locked position, pointing slightly to the right from the front view. In addition, actuator 68 and rotatable latch 66 are vertically aligned in this embodiment, such that actuator 68 is positioned directly below rotatable latch 66. In some examples, the two components may be vertically offset, such that actuator 68 and rotatable latch 66 are not vertically aligned, but rather disposed to the right or left with respect to each other. A spring or similar bias member 80 is also shown in FIG. 3B. Bias member 80 may be used to bias tool 48 toward a locked configuration. In embodiments, bias member 80 may be used to bias tool 48 toward an unlocked configuration. Resiliently biasing tool 48, or any other tool disclosed herein, toward a locked or unlocked configuration may vary depending on the desires or needs of a particular tooling operation or the preferences of an operator.

Figure 3C:
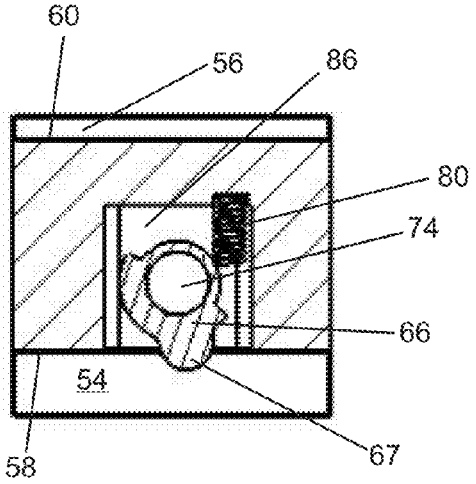
FIG. 3C is a section view of the tool, taken along line B-B of FIG. 3B.

FIG. 3C is a section view of tool 48, taken along line B-B of FIG. 3B. As illustrated, internal bias member 80 may be positioned to engage with rotatable latch 66. In this embodiment, shaft 74 may be attached or coupled with rotatable latch 66. As shown, rotatable latch 66 may circumferentially surround a portion of shaft 74. Each of rotatable latch 66 and shaft 74 are disposed substantially within latch cavity 86.

In embodiments, bias member 80 may comprise a spring. The particular type of spring, e.g., linear or non-linear, may vary and any type of spring may be used. As illustrated in FIG. 3C, bias member 80 may be laterally oriented such that one end is secured to an inner portion of tool 48, and a second end, opposite the first, is positioned to engage with rotatable latch 66. In some examples, such as that shown, rotatable latch 66 may be resiliently biased toward a locked or latched position by bias member 80, in which locking protrusion 67 protrudes from front surface 62. According to such embodiments, movement of actuator 68 may be necessary to rotate shaft 74, which causes rotatable latch 66 to rotate so that locking protrusion 67 recedes into latch cavity 86, thereby compressing bias member 80 and allowing release or insertion of tool 48 with respect to an unclamped tool holder. Upon subsequent release of actuator 68, the compression force acting on bias member 80 is also released, causing bias member 80 to extend, thereby rotating locking protrusion 67 back into a locked position. Thus, manual adjustment of actuator 68 may only be necessary to achieve an unlocked configuration of tool 48. In embodiments, bias member 80 may be coupled to one or more of rotatable latch 66, shaft 74 and actuator 68.

As further illustrated in FIG. 3C, the width of shoulder portions 54, 56 may be different. In the embodiment shown, shoulder portion 54 is wider than shoulder portion 56. Differently sized shoulder portions may be necessary to accommodate the internal latch mechanisms disclosed herein and/or to fit different tool holder designs. Shoulder portions 54 and/or 56 may be configured for transmission of a load from a tool holder through the body of tool 48 to working end 50.

Latch cavity 86 may be variously sized. In some examples, the depth at which latch cavity 86 extends within tang 52 may be greater or less than that depicted in FIG. 3C. For instance, latch cavity 86 may comprise a lateral through-hole defined by tang 52, open to reference face 58 and 60. According to such embodiments, tool 48 may reversibly couple with a tool holder receiving cavity on either or both sides of tang 52. In some examples, tool 48 may include two rotatable latches, one latch comprising a locking protrusion configured to protrude from reference face 58, the other from reference face 60. In some examples, both latches may be actuated simultaneously, thereby laterally securing tool 48 within a tool holder on two ledge portions, for example ledges 34 and 35 shown in FIG. 1E. Such dual-latch embodiments may be implemented to reinforce the coupling of relatively heavy tools within a corresponding tool holder.

Figure 3D:
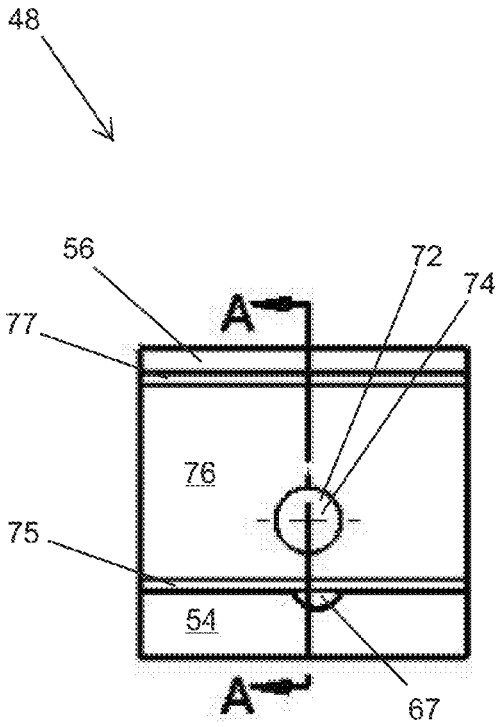
FIG. 3D is a top view of the tool.

FIG. 3D is a top view of tool holder 48. As shown, top surface 76 may define opening 72, which exposes the uppermost portion of shaft 74. Top surface 76 may be flanked on two sides by beveled surfaces 75, 77. Shoulder portions 54, 56 may remain visible at a lateral plane below top surface 76. In the locked configuration shown, locking protrusion 67 may protrude outwardly below top surface 76, overhanging shoulder portion 54.

Opening 72 comprises a circular cross-sectional shape in FIG. 3D. In embodiments, the shape of opening 72 may vary. In some examples, opening 72 may be shaped to approximately match the cross-sectional shape of shaft 74 to minimize a circumferential gap around shaft 74. In other embodiments, opening 72 may not be defined by top surface 76, thereby concealing shaft 74 from a top view of tool 48.

Figure 3E:
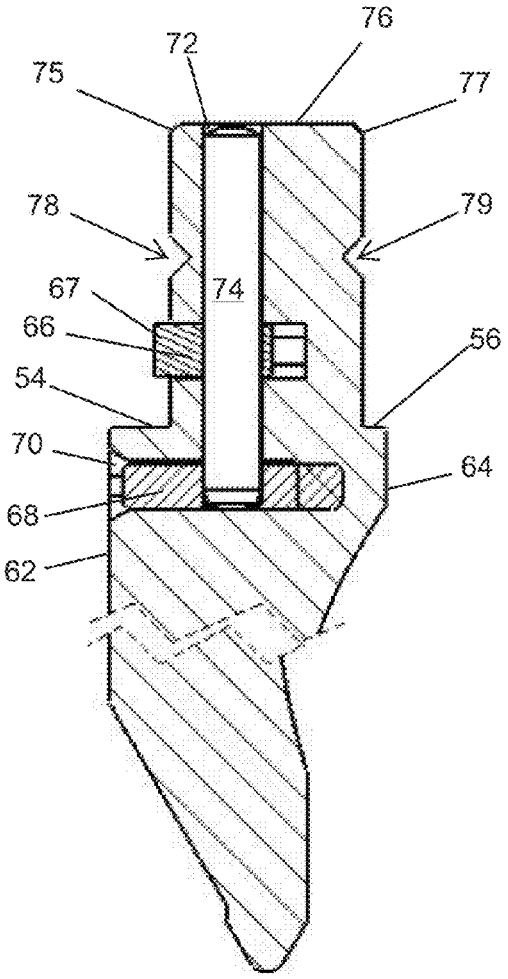
FIG. 3E is a section view of the tool, taken along line A-A of FIG. 3D.

FIG. 3E is a section view of tool 48, taken along line A-A of FIG. 3D. As illustrated in this example, shaft 74 may be positioned within tool 48, extending vertically from access window 70 to top surface 76. Shaft 74 may provide a longitudinal, mechanical link between rotatable latch 66 and actuator 68, operatively coupling the two components such that an operator may actuate rotatable latch 66 via actuator 68 even when tang 52 is manually inaccessible within the receiving cavity of a tool holder. Thus, shaft 74 may provide the vertical displacement between rotatable latch 66 and actuator 68 that may be necessary to lock and unlock tool 48 from an unclamped tool holder. In the particular embodiment shown, shaft 74 is attached to actuator 68 and rotatable latch 66 such that movement of actuator 68 rotates shaft 74 and rotatable latch 66. Thus, shaft 74 may be rotationally coupled to rotatable latch 66, such that rotatable latch 66 may rotate laterally about a vertical axis defined by shaft 74.

The length of shaft 74 may vary and may depend on the amount of vertical displacement needed to actuate rotatable latch 66 after insertion of tool 48 with a tool holder. In embodiments, shaft 74 may extend at least from a position within tang 52 to a position below shoulders 54, 56. The angle of shaft 74 may also vary. In the embodiment shown, shaft 74 is positioned at an approximately 90° angle with respect to top surface 76. In other examples, shaft 74 may be offset from the vertical axis, leaning toward shoulder portion 54 or 56 and/or side surface 63 or 65. As further shown in FIG. 3E, shaft 74 may comprise a unitary component. In other examples, shaft 74 may comprise multiple parts. In some examples, shaft 74 may be coupled with one or more additional components that may be necessary to translate movement of actuator 68 into rotation of rotatable latch 66. Such components may adjust the force required to move rotatable latch 66 from a locked to an unlocked position, for example. In some embodiments, shaft 74 may be rigidly attached or indirectly coupled to actuator 68 and/or rotatable latch 66. Shaft 74 may also be integrally formed with rotatable latch 66.

In embodiments, the depth of access window 70 may also vary. In some examples, access window 70 may comprise a lateral through-hole extending from front surface 62 to rear surface 64. Such examples may enable an operator to manipulate actuator 68 from front surface 62 and/or rear surface 64. In embodiments that include lever- and/or knob-like actuation mechanisms, for instance, an actuation member may be positioned on both ends of such an access window or opening, or similar aperture configured for manual operator access to the actuator mechanism.

Figure 4A:
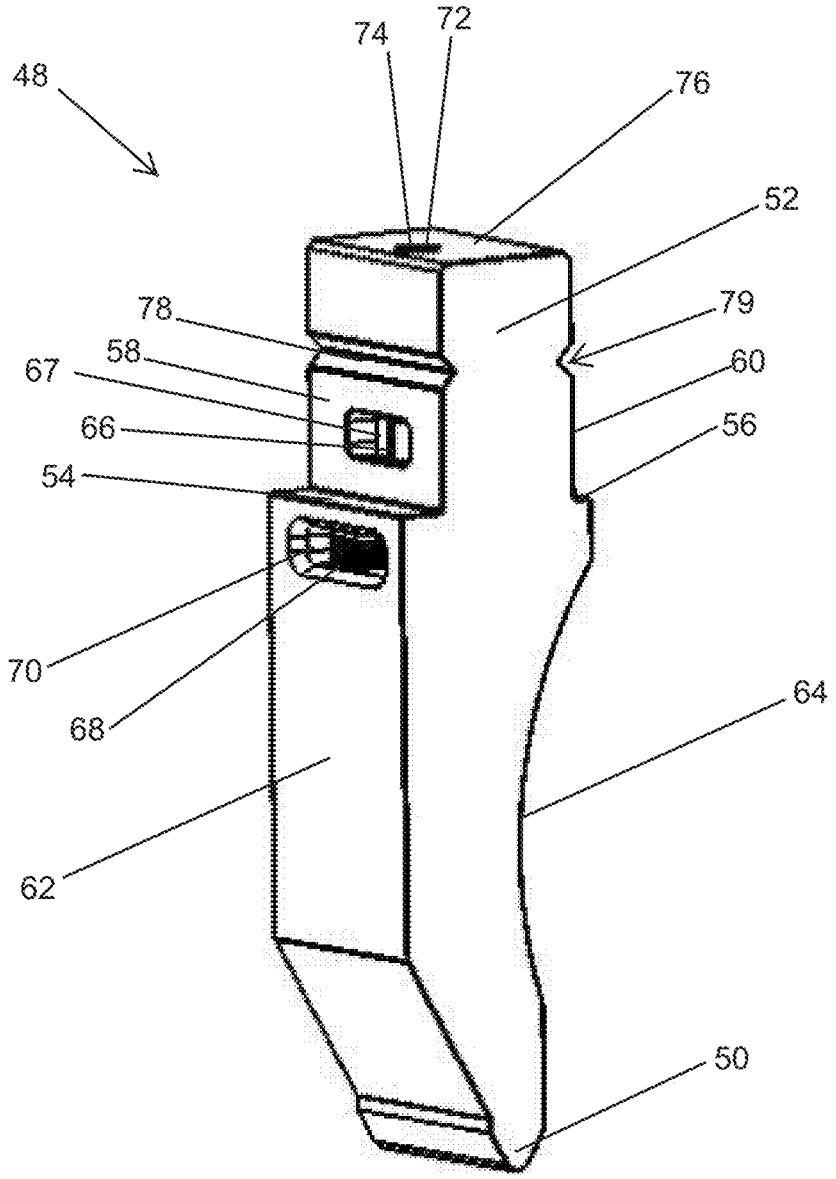
FIG. 4A is another isometric view of the tool in FIG. 3, showing the rotatable latch and the actuator in a disengaged configuration.

FIG. 4A is another isometric view of tool 48, showing rotatable latch 66, locking protrusion 67, and actuator 68 in an unlocked configuration. In an unlocked configuration, locking protrusion 67 may not protrude from reference face 58 of tang 52, instead remaining positioned within tang 52. Without locking protrusion 67 extending within a receiving cavity of an unclamped tool holder, tool 48 may not be attached, secured, or otherwise coupled with the holder, allowing tool 48 to be removed from the holder by lowering it therefrom. Likewise, without interference from locking protrusion 67, the unlocked configuration shown in FIG. 4A may allow vertical insertion of tang 52 into a receiving cavity of a tool holder. After insertion, actuator 68 may be released or moved to effect rotation of rotatable latch 66 back into a locked configuration.

Figure 4B:
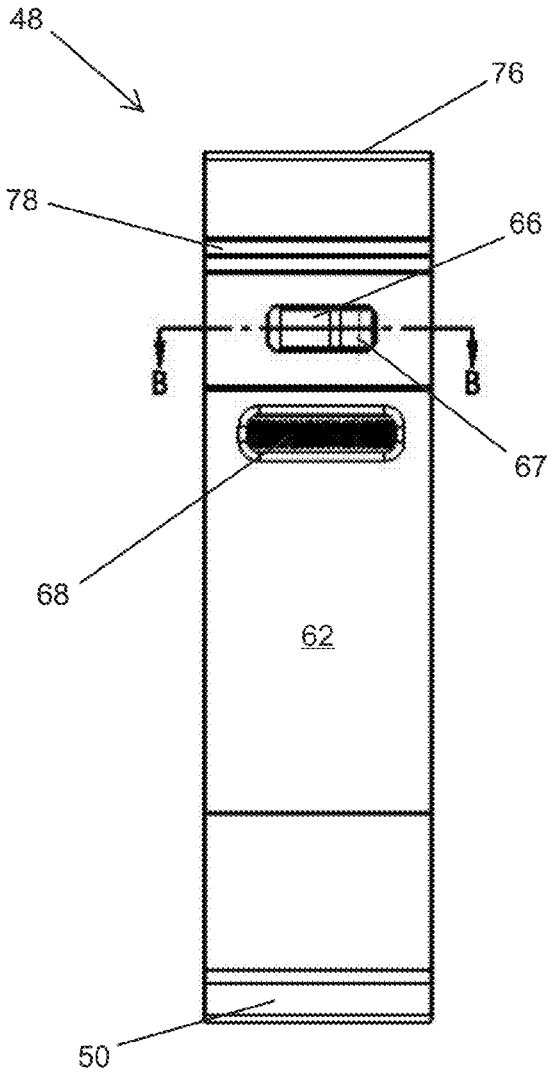
FIG. 4B is a front view of the tool in FIG. 4A.

FIG. 4B is a front view of tool 48 in an unlocked configuration. In the unlocked configuration depicted, rotatable latch 66 has rotated such that locking protrusion 67 is positioned to the right relative to its position shown in FIG. 3B. In this position, bias member 80 may not be visible from the front view.

Figure 4C:
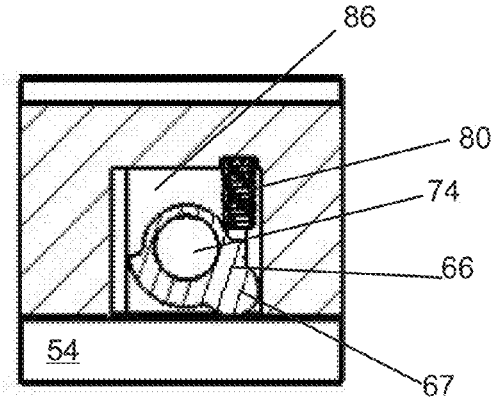
FIG. 4C is a section view of the tool, taken along line B-B of FIG. 4B.

FIG. 4C is a section view of tool 48, taken along line B-B of FIG. 4B. As shown in FIG. 4C, rotatable latch 66 may be rotated to an unlocked position in which locking protrusion 67 is positioned entirely within latching cavity 86, and thus tang 52. In this configuration, locking protrusion 67 may not overhang shoulder portion 54. Bias member 80 may also be at least partially compressed.

Figure 4D:
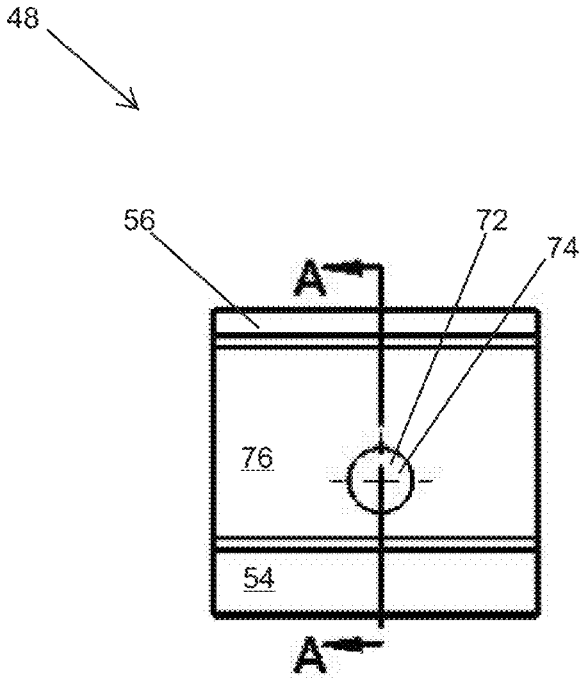
FIG. 4D is a top view of the tool.

FIG. 4D is a top view of tool 48 in unlocked configuration. Because locking protrusion 67 resides within latching cavity 86 of tang 52 in this configuration, locking protrusion 67 is not visible from a top view of tool 48. Locking protrusion 67 may be flush with reference face 58, for example.

Figure 4E:
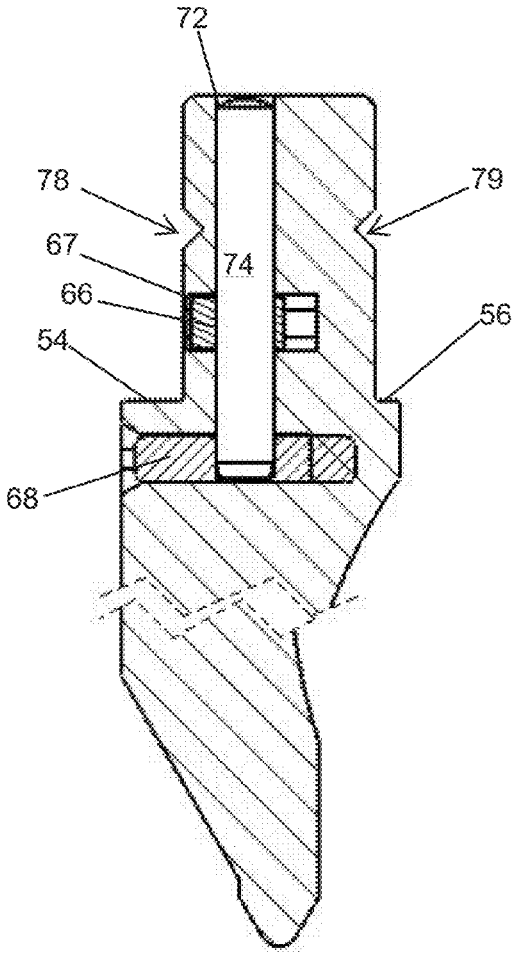
FIG. 4E is a section view of the tool, taken along line A-A of FIG. 4D.

FIG. 4E is a section view of tool 48 in an unlocked configuration. FIG. 4E also shows locking protrusion 67 tucked within tang 52. This positioning of locking protrusion 67 results from moving actuator 68, which causes rotation of rotatable latch 66 via rotation of shaft 74. By engaging or rotating actuator 68 to move locking protrusion 67 within tang 52, tool 48 may be unlocked and removed from a tool holder or inserted therein.

Figure 5A:
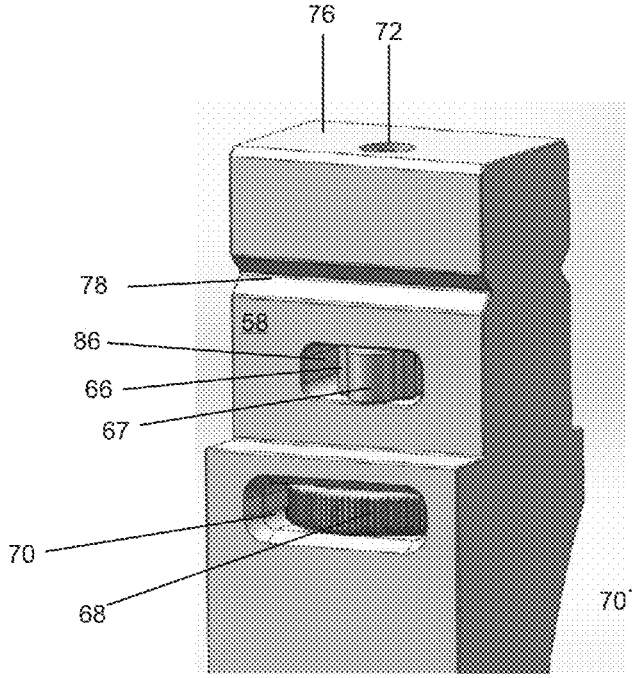
FIG. 5A is an alternate isometric view of the tool in FIGS. 3 and 4 in an engaged configuration.
Figure 5B:
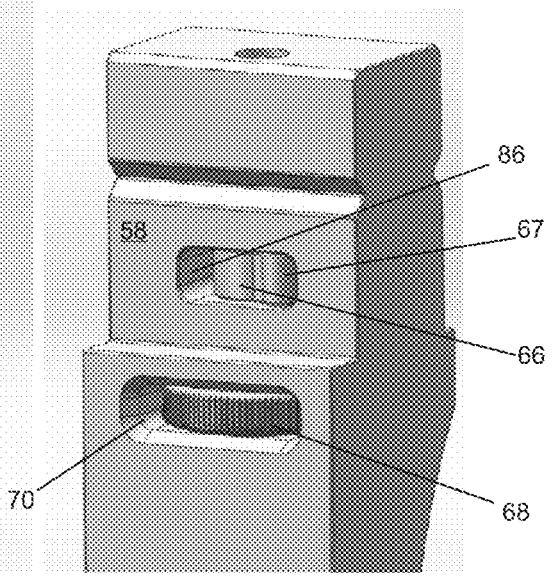
FIG. 5B is an alternate isometric view of the tool in a disengaged configuration.

FIGS. 5A and 5B together show rotatable latch 66 and locking protrusion 67 in a locked (FIG. 5A) and unlocked (FIG. 5B) configuration. In a locked configuration, shown in 5A, rotatable latch 66 is rotated such that locking protrusion 67 protrudes laterally outwardly from reference face 58 of tang 52, overhanging shoulder portion 54. In this configuration, locking protrusion 67 may rest on, insert into, or otherwise engage with a recess, shelf or ledge portion defined by the receiving cavity of a tool holder such that tool 48 remains coupled with a tool holder even before the tool holder is activated to clamp tool 48 therein.

FIG. 5B shows tool holder in an unlocked configuration. As shown, rotatable latch 66 has rotated back within latch cavity 86 such that locking protrusion 67 no longer protrudes from reference face 58. In this configuration, tool 48 may be removed from or inserted into an unclamped tool holder.

In the embodiment shown in FIGS. 5A and 5B, actuator 68 comprises a rotatable knob textured to increase the friction between actuator 68 and an operator's finger, for example, thus facilitating reliable engagement of actuator 68 by an operator.

Additional Configurations

Figure 6A:
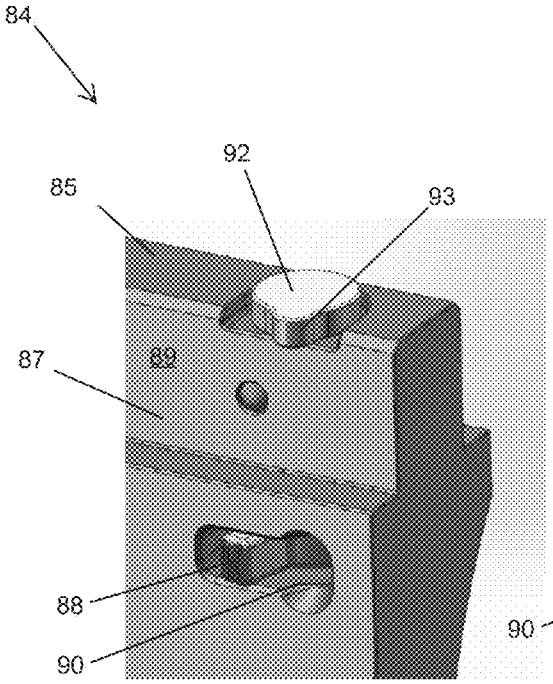
FIG. 6A is an isometric view of an upper portion of a tool for a press brake or similar machine apparatus, showing an alternate rotatable latch and actuator configured in an engaged position.
Figure 6B:
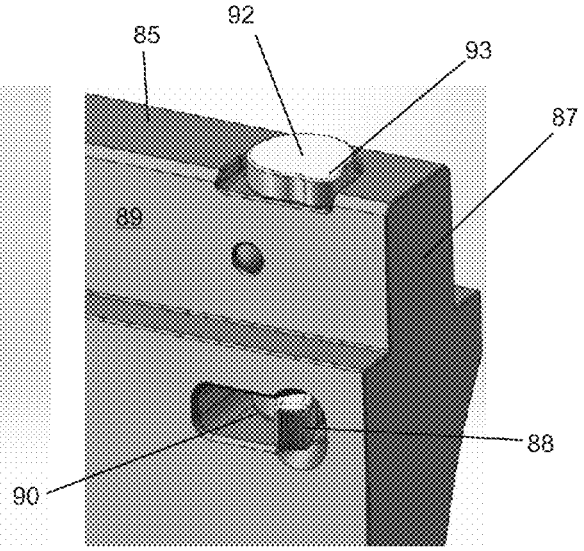
FIG. 6B is an isometric view of the tool in FIG. 6A in a disengaged position.

FIGS. 6A and 6B are each isometric views of an upper portion of tool 84 for a press brake or similar machine apparatus. As shown, top surface 85 may define a recessed portion to accommodate rotatable latch 92 such that rotatable latch 92 may be positioned on top of tang 87. Rotatable latch 92 includes locking protrusion 93. In this embodiment, actuation mechanism (or actuator) 88 comprises a lever accessible through access window or opening 90.

FIG. 6A shows tool 84 in a locked configuration, in which locking protrusion 93 protrudes outwardly from reference face 89. This particular example, in which rotatable latch 92 is positioned atop tang 87, may be necessary to accommodate a certain receiving cavity defined by a particular tool holder. This specific placement of rotatable latch 92 may also be necessary to reversibly lock tools having shorter tang portions. For instance, after insertion into a tool holder, only the top surface of the tang may reach the shelf or ledge portion defined by a tool holder receiving cavity. As such, positioning the rotatable latch on top of the tang may eliminate the need to form additional receiving cavities within the tool holder or append attachments to the tool.

FIG. 6B shows tool 84 in an unlocked configuration. As illustrated, locking protrusion 93 does not protrude outwardly from reference face 89 in this configuration. To drive rotation of rotatable latch 92 and locking protrusion 93, actuator 88 has been moved to the right within access window 90. An internal shank or shaft may translate movement of actuator 88 into rotation of rotatable latch 92. Tool 84 may also comprise an internal bias member, such that release of actuator 88 from its position shown in FIG. 6B automatically causes actuator 88, and thus rotatable latch 92 and locking protrusion 93, to revert to the configuration depicted in FIG. 6A.

Figure 7A:
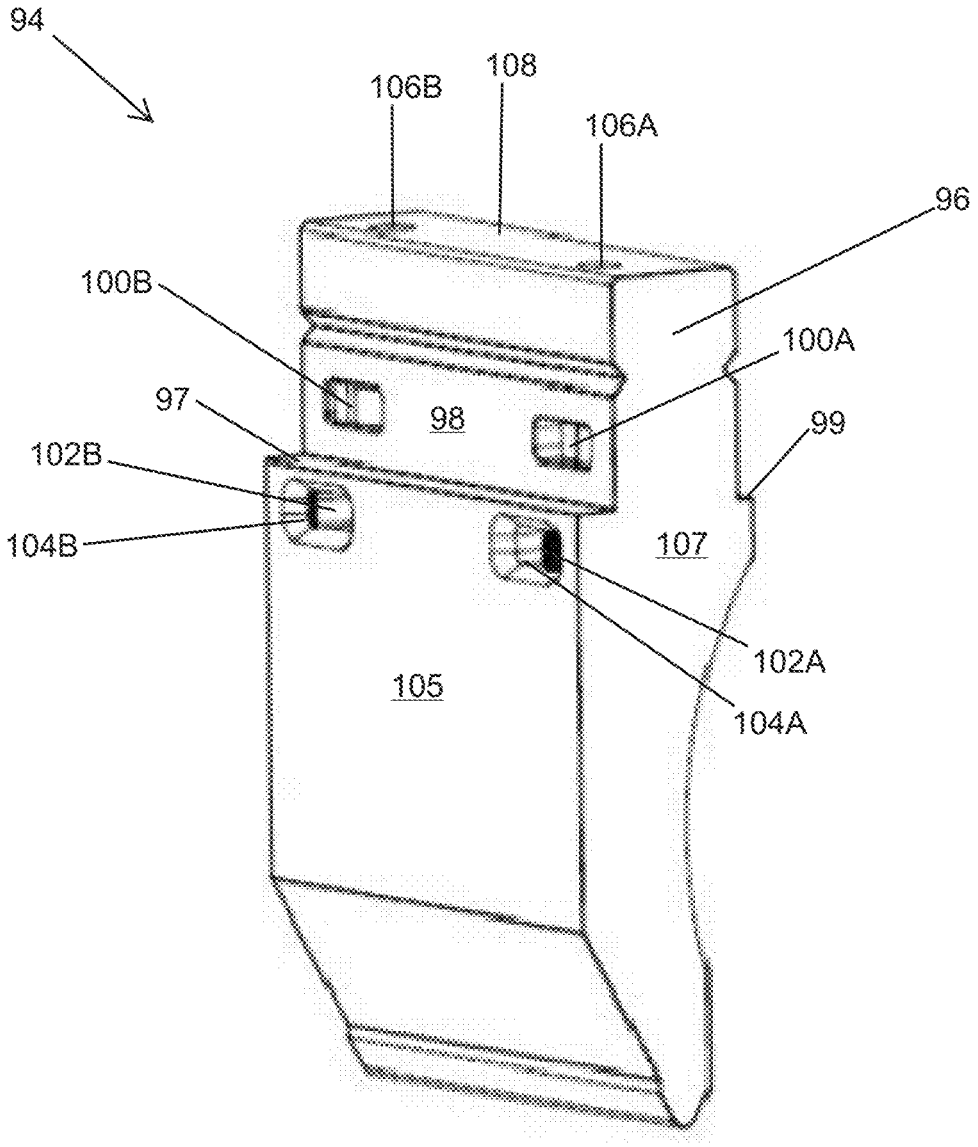
FIG. 7A is an isometric view of a tool for a press brake or similar machine apparatus, showing multiple locking assemblies.

FIG. 7A is an isometric view of tool 94 for a press brake or similar machine apparatus. As shown in FIG. 7A, tool 94 may include multiple locking assemblies, each comprising a rotatable latch coupled to an actuation member or actuator mechanism. The example of FIG. 7A includes two rotatable latches 100A and 100B exposed at reference face 98 of tang 96, and two actuator mechanisms 102A and 102B. Actuators 102A, 102B may remain accessible to an operator upon insertion of tang 96 into a tool holder via access windows or openings 104A and 104B, each defined by front surface 105. As further shown in FIG. 7A, tool 94 may include top surface 108, which defines openings 106A and 106B. Shoulder portions 97 and 99 extend outwardly from the base of tang 96.

The embodiment shown in FIG. 7A, with one locking assembly near each end of tool 94, may be implemented for particularly large and/or heavy tools. For smaller and/or lighter tools, one locking assembly may be sufficient to hold a tool in place within an unclamped tool holder. An operator of tool 94 may manipulate actuator 102A with one hand and actuator 102B with the other. In embodiments, rotatable latches and corresponding actuator mechanisms may be included along the length of a tool. In some examples, the number of such locking assemblies may vary, ranging from about 1 to about 20 locking assemblies.

Figure 7B:
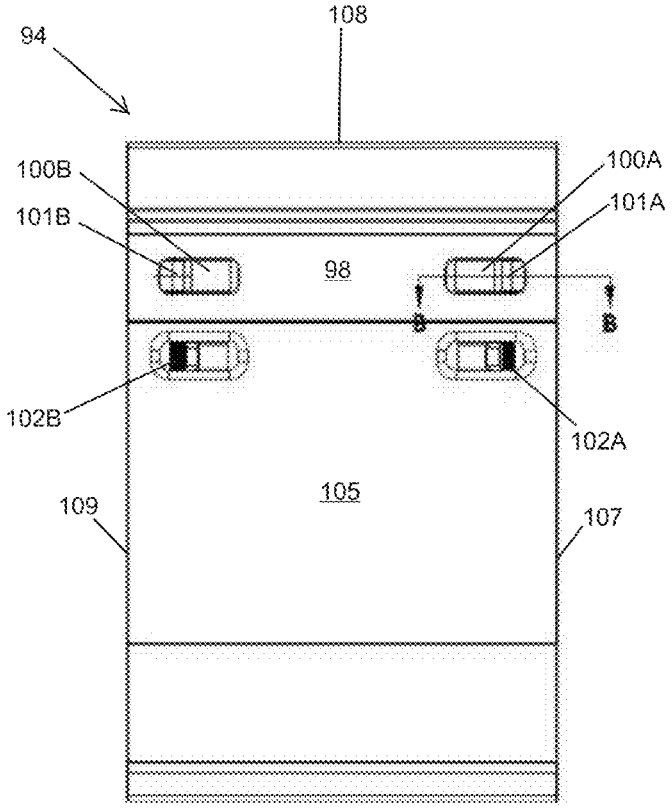
FIG. 7B is a front view of the tool in FIG. 7A.

FIG. 7B is a front view of tool 94. As shown, actuators 102A and 102B may be configured to move in opposite directions to unlock tool 94 from a tool holder. Accordingly, locking protrusions 101A and 101B are similarly oriented away from each other in the example shown.

In this particular embodiment, the locking assemblies of tool 94 are positioned such that tool 94 has mirror image symmetry when viewed from the front. In particular, rotatable latch 100A and actuator 102A are the same distance from end surface 107 that rotatable latch 100B and actuator 102B are from end surface 109. In embodiments, the position of rotatable latches 100A, 100B and/or actuators 102A, 102B may vary with respect to front surface 105 and/or each other.

Figure 7C:
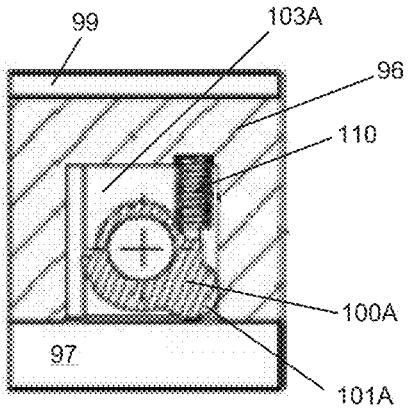
FIG. 7C is a section view of the tool, taken along line B-B of FIG. 7B.

FIG. 7C is a section view of tool 94, taken along line B-B of FIG. 7B. Rotatable latch 100A is illustrated in an unlocked configuration, in which rotatable latch 100A is rotated such that locking protrusion 101A is positioned entirely within latch cavity 103A. As such, locking protrusion 101A does not overhang shoulder portion 97. FIG. 7C also depicts bias member 110. Bias member 110 may be at least partially compressed in the unlocked configuration shown, such that rotatable latch 100A is biased toward a locked configuration in which locking protrusion 101A protrudes from tang 96.

Figure 7D:
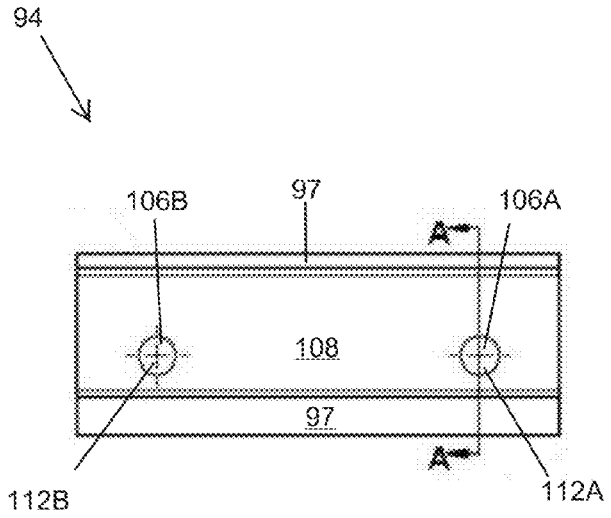
FIG. 7D is a top view of the tool.

FIG. 7D is a top view of tool 94 in an unlocked configuration. As shown, neither locking protrusion 101A nor 101B may overhang shoulder portion 97 in this configuration. Top surface 108 may define openings 106A and 106B, exposing shafts 112A and 112B, respectively.

Figure 7E:
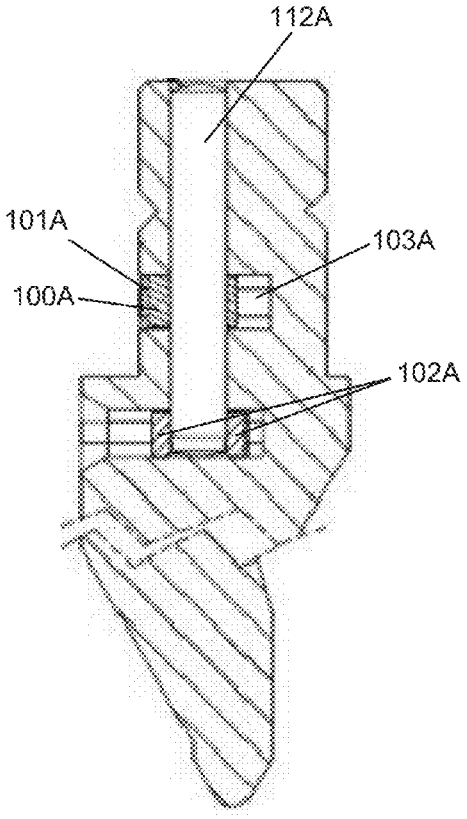
FIG. 7E is a section view of the tool, taken along line A-A of FIG. 7D.

FIG. 7E is a section view of tool 94, taken along line A-A of FIG. 7D. FIG. 7E shows shaft 112A rotationally coupling actuator mechanism 102A with rotatable latch 100A in an unlocked configuration. As illustrated, locking protrusion 101A is rotated entirely within latch cavity 103A. The portion of actuator mechanism 102A circumferentially attached to shaft 112A is also shown in FIG. 7E.

In embodiments, the operative coupling of actuation members 102A and 102B with rotatable latches 100A and 100B may vary. For instance, each rotatable latch may be operatively coupled to one or more actuation members or mechanisms 102A, 102B. In the embodiment shown in FIG. 7E, rotatable latch 100A is operatively coupled only to actuator mechanism 102A via shaft 112A. Such operative coupling of a single actuator mechanism to a single rotatable latch, where each actuator mechanism is configured to independently rotate its respective latch, may be desirable to ensure that movement of each actuator may be necessary to remove a tool from an unclamped tool holder. In additional examples, rotatable latch 100A may be operatively coupled to both mechanisms 102A and 102B, such that movement of either actuator 102A or actuator 102B may independently cause rotation of rotatable latch 100A. Coupling one or more rotatable latches to multiple, perhaps all, actuator mechanisms included in a particular tool may be implemented to accommodate embodiments in which only one end of a tool, and thus one actuator, may be accessible to an operator when the tool is coupled to a tool holder. In such embodiments, it may be advantageous to enable an operator to unlock each rotatable latch by manipulating only a single actuator mechanism.

Operatively coupling multiple rotatable latches to a single actuation member or actuator mechanism may require additional components coupled to an internal shaft, such as shafts 112A and/or 112B. For example, a horizontally oriented shank, shaft, or crossbar may link shaft 112A to shaft 112B, propagating rotation of one shaft to rotation of the other shaft. In addition or alternatively, one or more gear assemblies and/or connector parts, for instance, may be coupled with shaft 112A and/or 112B.

Figure 8:
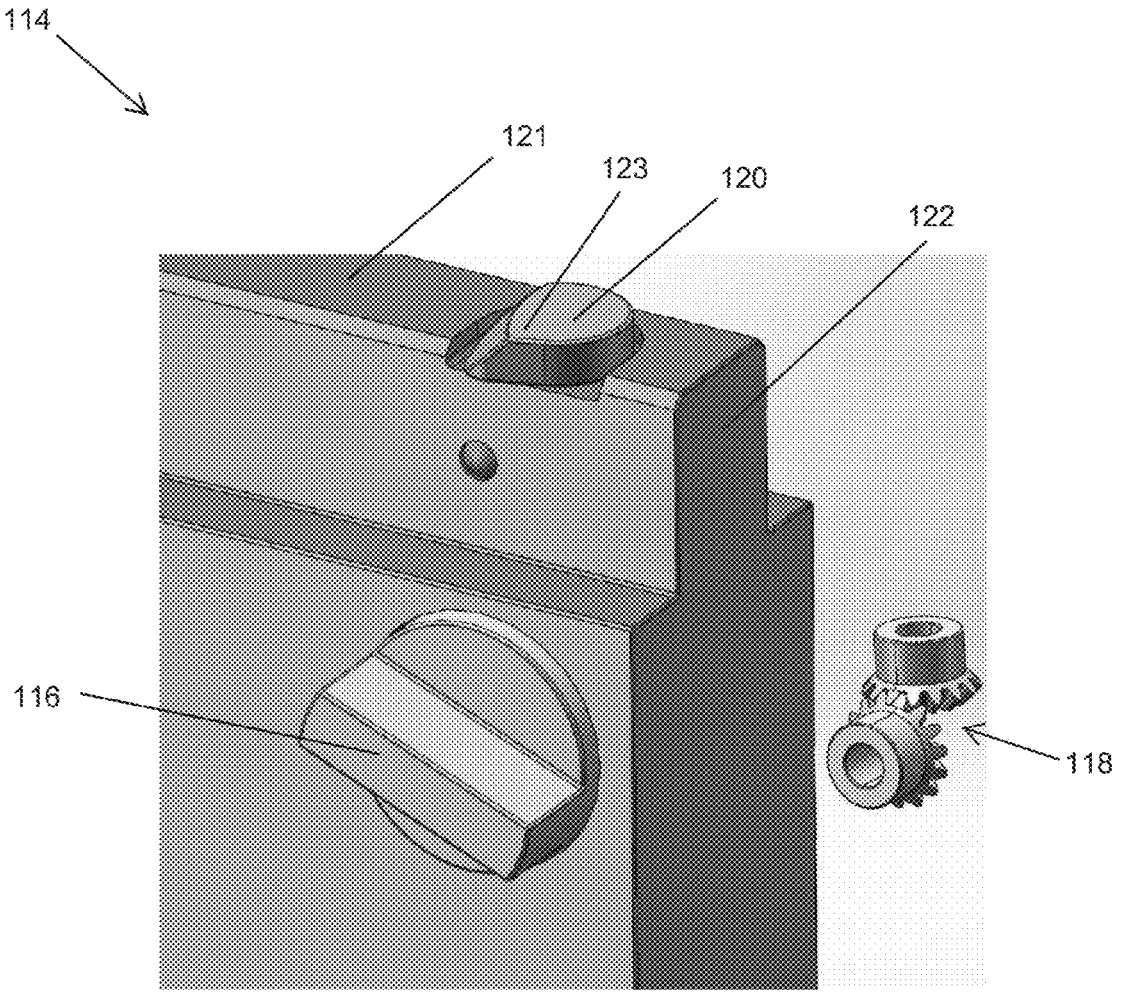
FIG. 8 is an isometric view of an upper portion of a tool for a press brake or similar machine apparatus, showing an internal gear assembly and alternate actuator configuration.

FIG. 8 is an isometric view of an upper portion of tool 114 for a press brake or similar machine tool apparatus. Tool 114 includes an actuator 116 and rotatable latch 120. As shown, rotatable latch 120 may be positioned atop tang 122, embedded within top surface 121. FIG. 8 also illustrates gear assembly 118 that although positioned internally within tool 114, is depicted as a separate component for clarity.

In this example, actuator 116 comprises a protruding, rotatable knob mechanism configured to rotate about a horizontal axis. Internal gear assembly 118 translates rotation of actuator 116 into rotation of a vertically oriented shank or shaft coupled to rotatable latch 120, thereby causing rotatable latch 120 to rotate about a vertical axis. As illustrated in FIG. 8, rotatable latch 120 has been rotated such that locking protrusion 123 protrudes outwardly from tang 122. Thus, FIG. 8 depicts tool 114 in a locked configuration.

The particular gear assembly 118 used to translate motion of actuator 116 into rotation of rotatable latch 120 may vary in embodiments. The particular embodiment shown comprises bevel gears. In some examples, gear assembly 118 may comprise one or more worm and gear and/or rack and pinion assemblies.

Figure 9A:
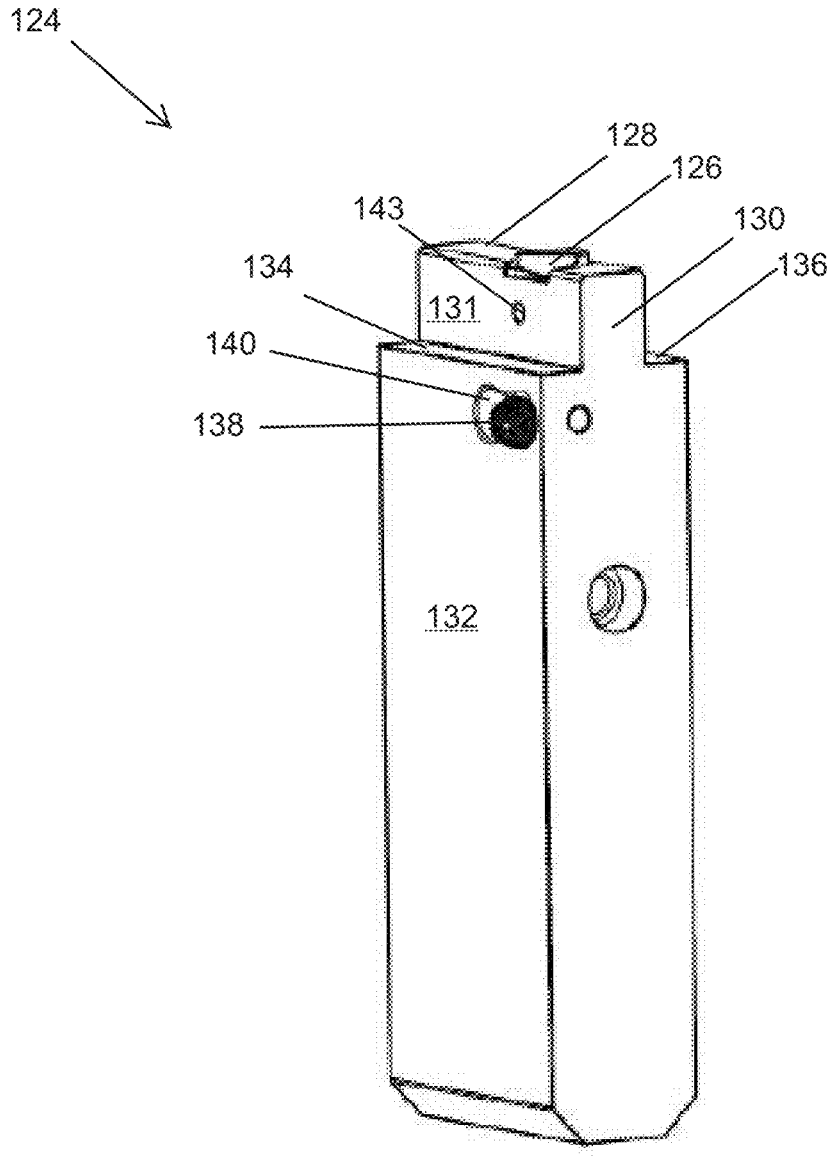
FIG. 9A is an isometric view of a tool for a press brake or similar machine apparatus.

FIG. 9A is an isometric view of tool 124 for a press brake or similar machine tool apparatus. As illustrated in FIG. 9A, tool 124 may include an actuator 138 exposed through front surface 132 via access window 140. Above shoulder portions 134 and 136, tool 124 may include tang 130. Rotatable latch 126 may be positioned atop tang 130, protruding above top surface 128. A movable rod or ball 143 may also be exposed at reference face 131 on the front-side surface of tang 130.

In the example shown in FIG. 9A, actuator 138 comprises a lever-style knob mechanism. As such, actuator 138 may be configured to move laterally relative to front surface 132, thereby rotating rotatable latch 126 between locked and unlocked configurations. In the embodiment shown, rotatable latch 126 is configured as a rotary cam or pawl with a tab, flange or similar protrusion 127 positioned in a locked configuration, rotated to extend outward from the (e.g. front) side surface 131 of tang 130.

Figure 9B:
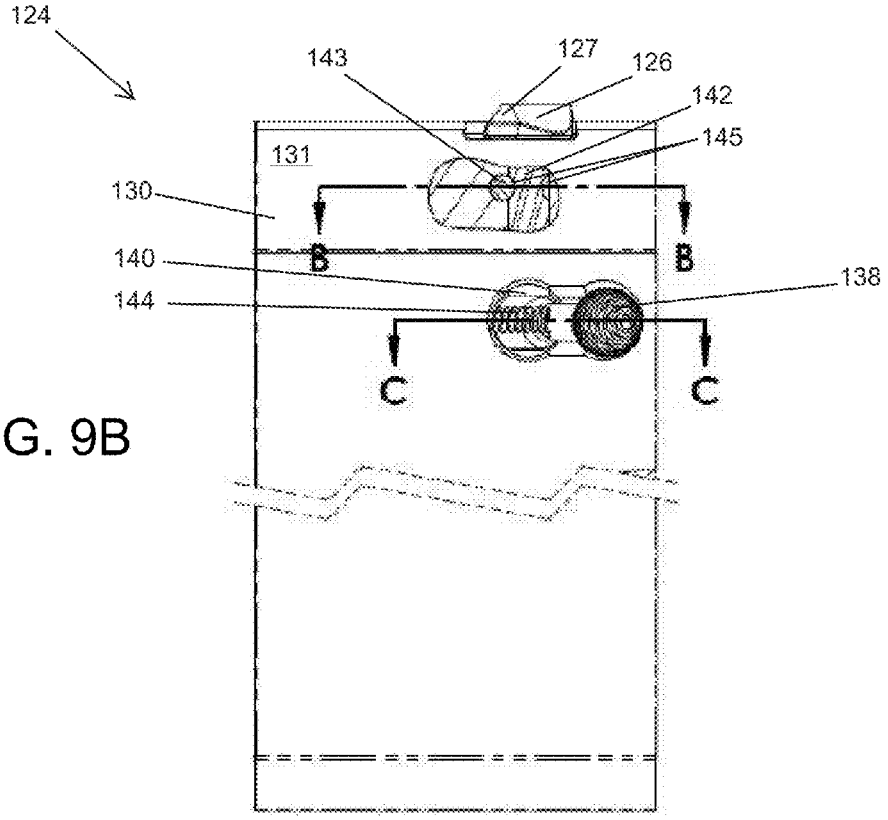
FIG. 9B is a front view of the tool in FIG. 9A.

FIG. 9B is front view of tool 124 in a locked configuration. As shown, locking protrusion 127 of rotatable latch 126 may be oriented to the left in a locked configuration, where it protrudes laterally outward from tang 130, e.g., with beveled surfaces configured to engage latch 126 within a recess or receiving cavity in the tool holder, as described herein. FIG. 9B also portrays a cut-away portion of tang 130, exposing internal shaft 142. In a locked configuration, bias member 144 may also be visible from a front view through access window or opening 140. Bias member 144 may be coupled directly or indirectly to actuator 138, such that actuator 138, and thus rotatable latch 126, may be biased toward a locked position.

As further illustrated in FIG. 9B, tool 124 may comprise one or more ball-plunger assemblies that include rod or ball 143. As shown, ball 143 may alternately engage one of two detents 145 formed in shaft 142. Reversibly coupling ball 143 with one of two detents 145 may comprise one example of a bi-stable mechanism used to resiliently hold tool 124 in either a locked or unlocked configuration.

Figure 9C:
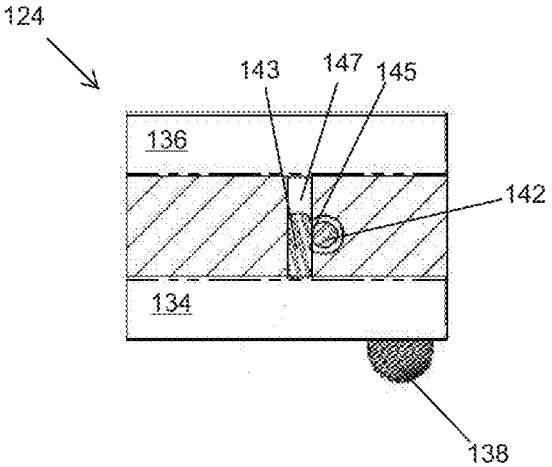
FIG. 9C is a section view of the tool, taken along line B-B of FIG. 9B.

FIG. 9C is a section view of tool 124, taken along line B-B of FIG. 9B. FIG. 9C shows actuator mechanism 138 protruding laterally outward from tool 124 and oriented to the right in a locked configuration. In embodiments, actuator 138 may be oriented to the left in a locked configuration, depending on the configuration of internal shaft 142 and rotatable latch 126. In embodiments such as that shown in FIG. 9C, shoulder portions 134 and 136 may comprise approximately equal surface areas.

FIG. 9C also illustrates a cross section of shaft 142. As shown, shaft 142 may comprise an approximately circular cross section, with at least one detent 145. Rod or ball 143 may reversibly engage detent 145 from its position within lateral cavity 147, thereby resiliently biasing tool 124 in a locked or unlocked configuration.

Figure 9D:
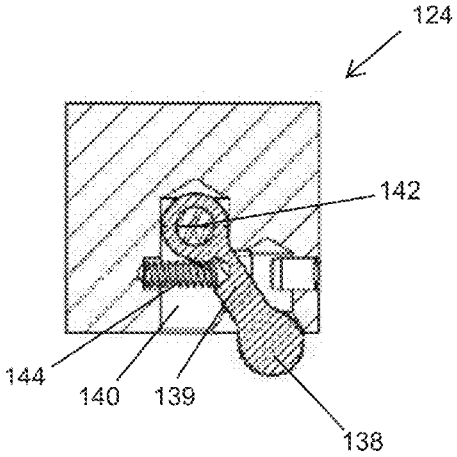
FIG. 9D is an alternate section view of the tool, taken along line C-C of FIG. 9B.

FIG. 9D is another section view of tool 124, taken along line C-C of FIG. 9B. FIG. 9B more closely illustrates actuator 138 and its attachment to shaft 142. As shown, actuator 138 may include elongate portion 139, which may circumferentially surround and attach to shaft 142. Bias member 144 may be laterally oriented within access window 140, attached to an internal surface of tool 124 at one end and actuator 138 at a second end. Tool 124 may be biased toward a locked configuration via bias member 144. In particular, bias member 144 may be stretched from a resting state by lateral movement of actuator 138. Such movement of actuator 138, to the right in this particular example, may cause rotation of shaft 142 and thus rotation of rotatable latch 126. Upon release of actuator 138, bias member 144 may compress back to a resting state, thereby also moving actuator 138 back to the left. Such movement of actuator mechanism 138 may rotate shaft 142 and rotatable latch 126 back into a locked configuration.

Figure 9E:
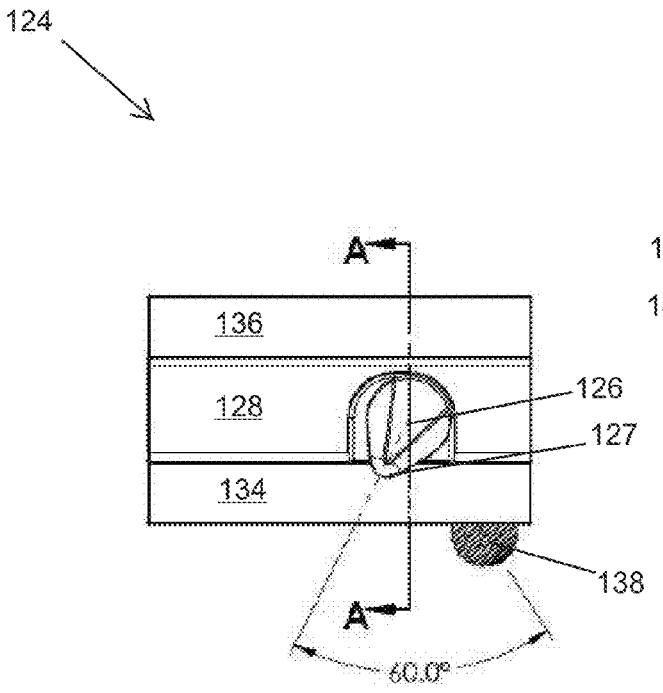
FIG. 9E is a top view of the tool.

FIG. 9E is a top view of tool 124. As shown, top surface 128 may include a cut-out portion or recess for rotatable latch 126. FIG. 9E also illustrates an exemplary angular relationship between locking protrusion 127 and actuator 138. In particular, the angular difference between the lateral orientation of actuator 138 and locking protrusion 127 may be about 60° in a locked configuration. In embodiments, the angular difference between actuator 138 and locking protrusion 127 may vary. For example, the angular difference between the two components may be 0°. Such an angular difference may be implemented in embodiments that include a spring that must be compressed to bias tool 124 toward a locked configuration.

Figure 9F:
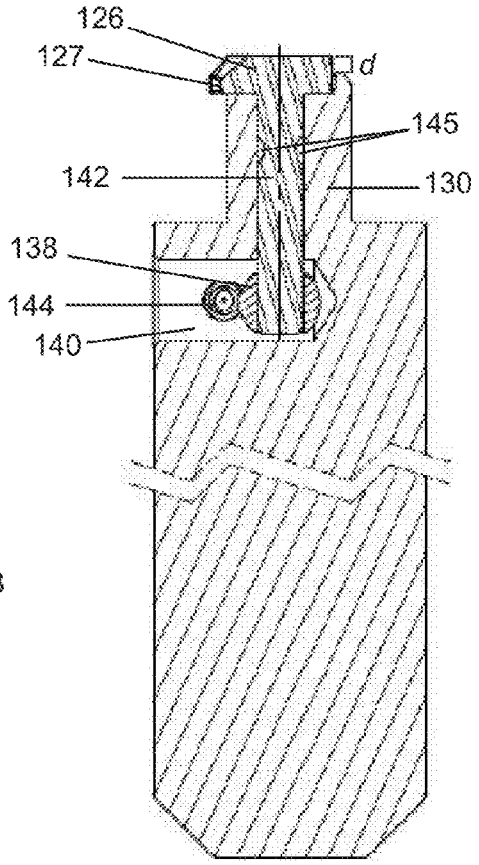
FIG. 9F is another section view of the tool, taken along line A-A of FIG. 9E.

FIG. 9F is a section view of tool 124, taken along line A-A of FIG. 9E. As shown in FIG. 9F, rotatable latch 126 may be integrally formed with latch 142. FIG. 9F also illustrates a cross section of bias member 144 and the portion of actuator 138 circumferentially surrounding shaft 142, all externally exposed by access window 140. FIG. 9F further depicts a distance, d, above top surface 128 by which rotatable latch 126 may extend. In embodiments, distance d may vary and may depend on the clearance between top surface 128 and the ceiling of a corresponding receiving cavity within a tool holder.

Figure 10:
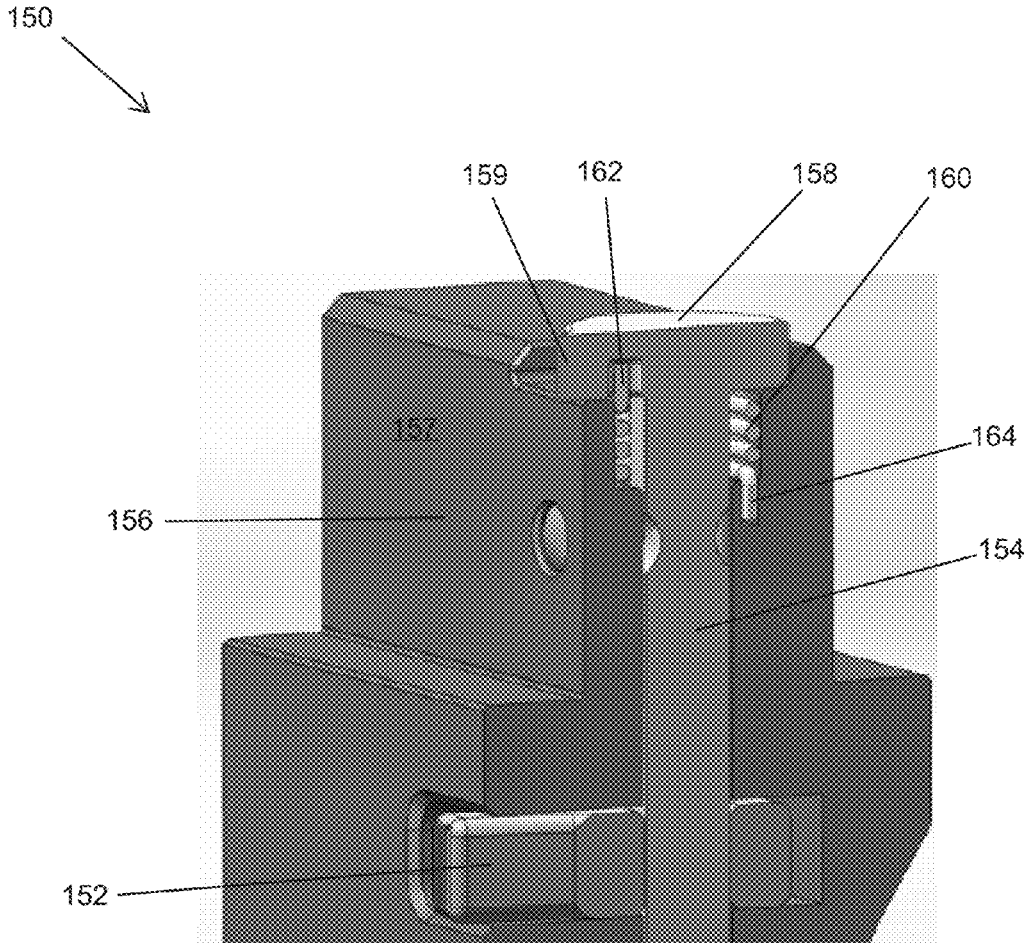
FIG. 10 is an isometric section view of a tool for a press brake or similar machine apparatus, showing an alternate bias member configuration.

FIG. 10 is an isometric section view of tool 150 in a locked configuration. As shown, tool 150 may include a bias member in the form of torsion spring 160. Tool 150 may also include actuator 152 operatively coupled to rotatable latch 158, which is integrally formed with shaft 154 in this example. In the locked configuration shown, locking protrusion 159 protrudes laterally outward from reference face 157 of tang 156.

Torsion spring 160 may comprise first end 162 and second end 164. As shown, first end 162 may be attached to rotatable latch 158 and second end 164 may be fixed to an internal portion of tang 156. Via torsion spring 160, tool 150 may be biased toward a locked configuration. In particular, movement of actuator mechanism 152 to unlock tool 150 may cause rotation of shaft 154 and thus rotatable latch 158. First end 162, attached to rotatable latch 158, may thus also rotate about the center axis of torsion spring 160, twisting torsion spring 160 away from its resting state position. Upon release of actuator 152, the torque created by twisting torsion spring 160 away from its resting state may drive rotation of first end 162 back into its original position, in which locking protrusion 159 protrudes laterally outward from reference face 157.

Figure 11A:
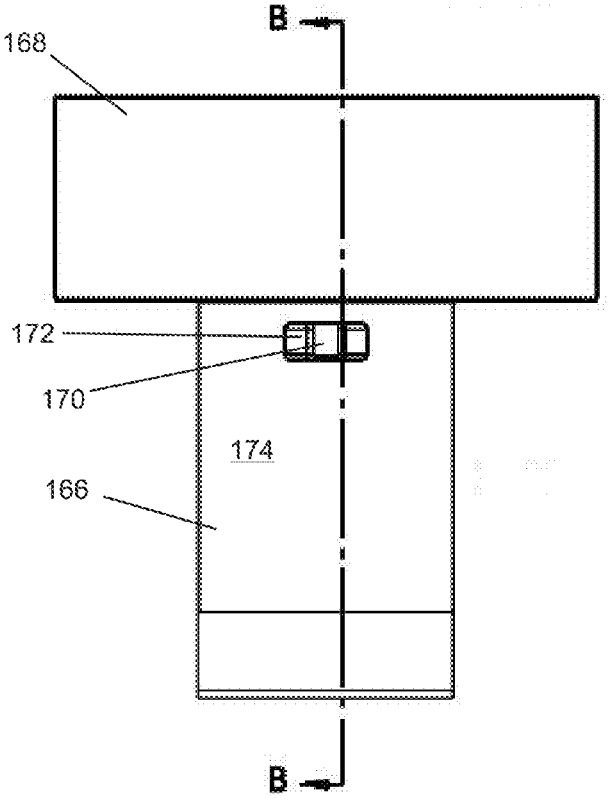
FIG. 11A is a front view of a tool coupled to a tool holder for a press brake or similar machine apparatus.

FIG. 11A is a front view of tool 166 coupled to holder 168 for a press brake or similar machine apparatus. As shown, tool 166 may include actuator 170 accessible to an operator via access window or opening 172 at front surface 174 of tool 166.

Figure 11B:
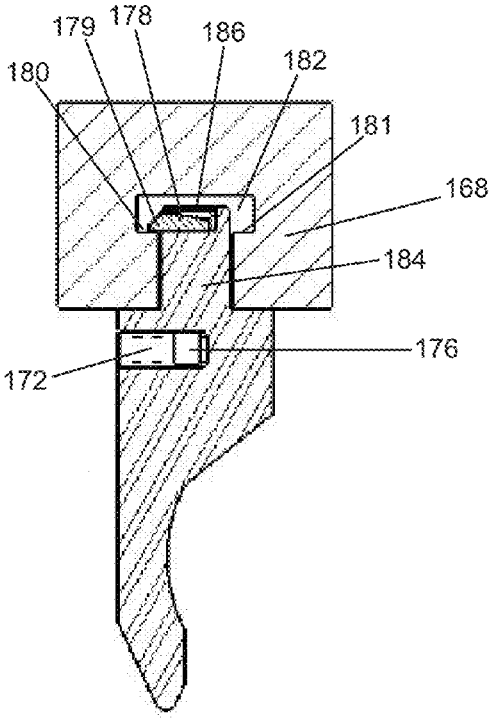
FIG. 11B is a section view of the tool and the holder in FIG. 11A, taken along line B-B of FIG. 11A.

FIG. 11B is a section view of tool 166, taken along line B-B of FIG. 11A. As illustrated, vertical shaft 176 may extend within access window 172, where it may be attached or coupled to actuator mechanism 170. FIG. 11B also shows tool holder 168, which defines receiving cavity 182 and ledges 180, 181. In the locked configuration shown, locking protrusion 179 of rotatable latch 178 protrudes laterally outward from tang 184. In this position, locking protrusion 179 may rest on ledge 180, thereby coupling tool 166 with holder 168.

As further illustrated in FIG. 11B, rotatable latch 178 may be vertically confined within tang 184, such that no portion of rotatable latch 178 protrudes above top surface 186.

Figure 11C:
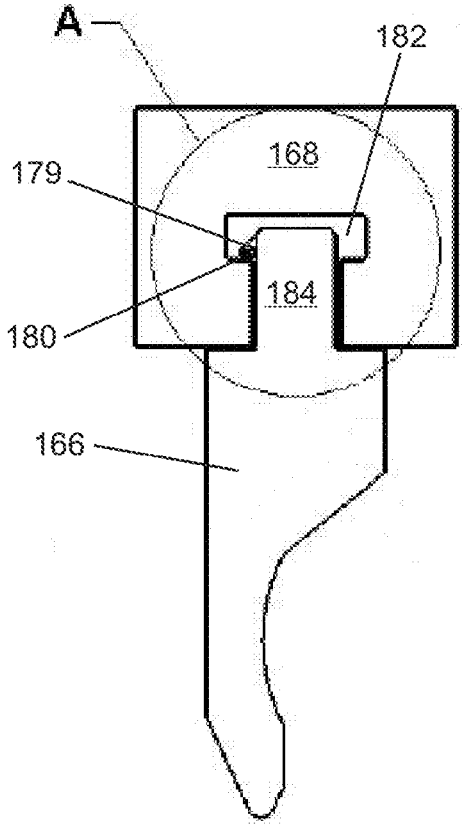
FIG. 11C is a side view of the tool and the holder.

FIG. 11C is a side view of tool 166 coupled to holder 168. FIG. 11C shows locking protrusion 179 extending away from tang 184 and onto ledge 180.

Figure 11D:
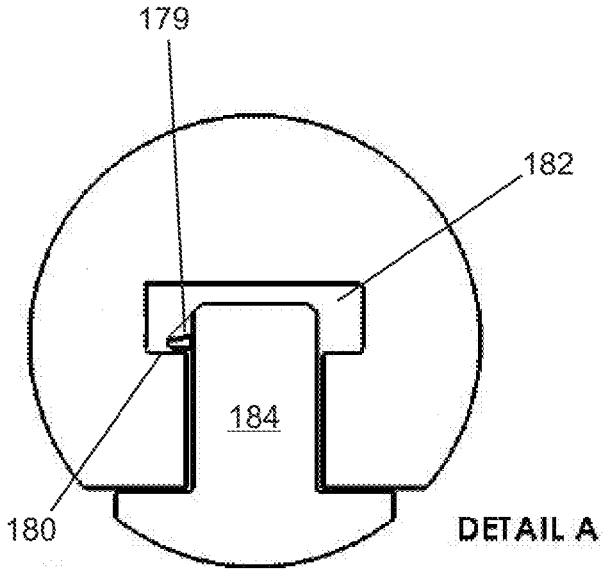
FIG. 11D is a detail view of the tool and the holder, taken at detail A of FIG. 11C.

FIG. 11D is a detail view of tool 166, taken at detail A of FIG. 11C. As shown, locking protrusion 179 may comprise the only portion of tang 184 protruding laterally into receiving cavity 182.

Methods of Formation and Operation

Providing the locking assemblies described herein, including the rotatable latches and/or actuator mechanisms (or actuation members), into otherwise standard tools configured for coupling to a press brake, punch, or similar machine apparatus may involve cutting the necessary cavities to include such components into the tang and/or upper portion of preexisting tools. Efficient adaptation of preexisting tools may involve drilling and/or reaming processes instead of fine milling and/or electric discharge machining methods, which may be more costly. The rotatable latch components disclosed herein may require the formation of primarily cylindrical cavities, which may be relatively simple to form. Alternatively, the rotary latch assembly can be provided in a new product design, where the required bores, apertures and other elements are formed by one or more molding and/or cutting, milling, drilling and similar machining processes.

In operation, the machine tool is engaged within the tool holder by manual operation of the actuator, in order to rotate a lobe or similar protrusion on the rotary component of the latch mechanism from the closed or engaged (locked) position to the open or disengaged (unlocked) position. The coupling end (e.g., a tang or top end) of the tool body can then be inserted into the tool holder for selective engagement by operation of the actuator to rotate the lobe or protrusion on the rotary component into coupling engagement with a cavity, recess, groove, or similar structure inside or on the tool holder. Alternatively, a spring or similar bias element is provided to bias the latch mechanism into the closed or locked position when the actuator is released.

For removal, the actuator is manipulated or operated to rotate the latch mechanism to the open or disengaged (unlocked) position, so that lobe or protrusion is disengaged from the recess or groove feature and tang end of the tool body is decoupled from the tool holder, so that the too body can be removed. The rotary component of the latch mechanism can also be provided with one or more beveled surfaces on the lobe or protrusion, so that the latch mechanisms rotates to the open position in response to insertion of the tang end into the tool holder. For example, the beveled surface(s) can be configured to urge the latch mechanism to the open position by interaction with a lower or outer end surface of the tool holder, as the tang end of the tool body is inserted. As the tang is fully inserted into the tool holder and the rotary component of the latch mechanism reaches the position of the internal recess or groove, the biasing element urges the rotary latch into the locked or engaged position. The cam lobe or similar protrusion on the rotary component of the latch mechanism then snaps into engagement with the internal cavity or groove, selectively coupling the tang end of the tool body to the tool holder as described herein.

Examples

A machine tool according to any of the examples and embodiments above can comprise: a tool body having a first end or working end configured for operation on a workpiece, and a second end or tang configured for coupling with a tool holder. A rotary latch mechanism is provided with a rotary component at least partially in or on the second end of the tool body, and configured for selective engagement and disengagement of the second end of the tool body with the tool holder. An actuator is configured to rotate the latch mechanism into first and second positions, respectively, where the rotary component selectively couples the second end of the tool body with the tool holder in the first position and selectively decouples the second end of the tool body from the tool holder in the second position.

A shaft can be provided, extending from the actuator to the rotary component of the latch mechanism and rotationally coupled thereto, where the shaft is operable by the actuator to rotate rotary component of the latch mechanism into the first and second positions.

In some embodiments, the latch mechanism includes a cam rotationally coupled to the shaft, the cam having a lobe configured to rotate outward from the second end of the tool body to engage with the tool holder in the first position, and to rotate inward toward the second end of the tool body to disengage with the tool holder in the second position.

In some examples, the rotary component of the latch mechanism is disposed within the tool holder with the first end of the tool body engaged therein, the shaft extending substantially vertically or longitudinally within or along the tool body between the actuator and the rotary component of the latch mechanism, the actuator being disposed in an accessible position on the tool body, below or outside the tool holder with the first end engaged in the tool holder. In some embodiments, the actuator includes a knob, lever or protrusion coupled to the shaft and further including an aperture disposed in the tool body for access to the actuator at the accessible position below or outside the tool holder.

A bias member can be provided, configured to resiliently bias the latch mechanism in one or both of the first and second positions. In some examples, a gear assembly can be provided, coupling the actuator to the rotary component of the latch mechanism and configured for rotation of the rotary component between the first and second positions by manual operation of the actuator.

In some embodiments, the first end of the tool body defines a tang and the latch mechanism includes a protrusion configured to rotate outward of a side surface of the tang to engage with a recess in the tool holder with the latch in the first position. The latch mechanism is disposed on a top surface of the tang in some examples.

One or more beveled surfaces may be provided on the protrusion, the beveled surfaces configured for engagement of the protrusion within the recess in the tool holder with the latch in the first position and for disengagement of the protrusion from the recess with the latch in the second position. For example, one or more beveled surfaces on the protrusion can be configured for urging the latch mechanism between the first and second positions by engagement with a surface of the tool holder when the second end of the tool body is inserted therein, and where the protrusion engages with the recess in the tool holder when the second end is fully inserted.

A press brake tool according to any of the examples and embodiments above can comprise: a tool body having a working end configured for operation on a workpiece and a coupling end configured for coupling the tool body to a tool holder; a shoulder configured for transmission of a load from the tool holder through the tool body to the working end; and an engagement mechanism adapted for selective engagement of the tool body with the tool holder. In any of the examples and embodiments above, the engagement mechanism can comprise: a latch configured to engage the coupling end of the tool body with the tool holder in a locked position and to disengage the coupling end of the tool body from the tool holder in an unlocked position; a shaft rotationally coupled to the latch; and an actuator member coupled to the shaft, where the actuator member is configured to rotate the latch between the locked and unlocked positions to selectively engage and disengage the tool body from the tool holder, respectively.

In some examples, the latch comprises a protrusion coupled to the shaft and configured to rotate outward from the coupling end of the tool body for engaging a recess in the tool holder in the locked position and to rotate inward toward the coupling end of the tool body to disengage from the recess in the tool holder in the unlocked position. In some embodiments, the protrusion extends from a side surface of the coupling end of the tool body in the locked position and the protrusion is disposed within or flush with the side surface of the tool body in the unlocked position.

A biasing member can be provided, configured to resiliently bias the latch in one or both of the locked and unlocked positions, the biasing member coupled to one or more of the latch, the shaft and the actuator member.

In some examples, the latch is disposed within the tool holder with the coupling end engaged therein, the shaft extending from the latch to the actuator disposed outside the tool holder for access to the engagement mechanism when the tool body is coupled to the tool holder.

In some embodiments, the shaft extends longitudinally within the tool body from the latch in the coupling end to the actuator. An access window can be provided, disposed in the tool body for access to the actuator. In some examples, the actuator comprises a handle, lever, knob or protrusion coupled to the shaft and configured for manual access via the window when the coupling end of the tool is engaged within the tool holder.

In some embodiments, the engagement mechanism can comprise: one or more additional latches configured to engage the coupling end of the tool body with the tool holder in respective locked positions and to disengage the coupling end of the tool body from the tool holder in respective unlocked positions; and an additional shaft rotationally coupled to each additional latch.

In some examples, the actuator member is mechanically coupled to each of the shafts to rotate each latch together between the locked and unlocked positions in order to selectively engage and disengage the tool body from the tool holder.

An additional actuator member can be provided, coupled to each additional shaft, where each actuator member is configured to independently rotate the respective latch between the locked and unlocked positions to selectively engage and disengage the tool body from the tool holder. In some embodiments, the actuator members are configured to independently rotate two of the respective latches in different directions, where the two respective latches have a substantially mirror image operational configuration.

While this invention has been described with respect to particular examples and embodiments, changes can be made and substantial equivalents can be substituted in order to adapt these teaching to other configurations, materials and applications, without departing from the spirit and scope of the invention. The invention is thus not limited to the particular examples that are disclosed, but encompasses all the embodiments that fall with the scope of the claims.

The invention claimed is:

1. A machine tool comprising:

a tool body having a first end configured for operation on a workpiece and a second end configured for coupling with a tool holder;

a latch mechanism comprising a rotary component provided at least partially in or on the second end of the tool body, the rotary component configured for selective engagement and disengagement with the tool holder;

an actuator configured to rotate the rotary component of the latch mechanism between first and second positions, respectively, wherein the rotary component selectively couples the second end of the tool body with the tool holder in the first position and selectively decouples the second end of the tool body from the tool holder in the second position.

2. The tool of claim 1, further comprising a shaft extending from the actuator to the rotary component of the latch mechanism and rotationally coupled thereto, wherein the shaft is operable by the actuator to rotate the rotary component of the latch mechanism between the first and second positions.

3. The tool of claim 2, wherein the rotary component of the latch mechanism comprises a cam rotationally coupled to the shaft, the cam having a lobe configured to rotate outward from the second end of the tool body to engage with the tool holder in the first position, and to rotate inward toward the second end of the tool body to disengage with the tool holder in the second position.

4. The tool of claim 2, wherein the shaft extends longitudinally along the tool body between the actuator and the rotary component of the latch mechanism, the actuator being disposed in an accessible position outside the tool holder on the tool body with the first end of the tool body engaged in the tool holder.

5. The tool of claim 4, wherein the actuator comprises a knob, lever or protrusion coupled to the shaft and further comprising an aperture disposed in the tool body for access to the actuator at the accessible position outside the tool holder.

6. The tool of claim 1, further comprising a bias member configured to resiliently bias the latch mechanism in one or both of the first and second positions.

7. The tool of claim 1, further comprising a gear assembly coupling the actuator to the rotary component of the latch mechanism, the gear assembly configured for rotation of the rotary component between the first and second positions by manual operation of the actuator.

8. The tool of claim 1, wherein the first end of the tool body defines a tang and the rotary component of the latch mechanism comprises a protrusion configured to rotate outward of a side surface of the tang to engage with a recess in the tool holder with the latch in the first position.

9. The tool of claim 8, wherein the rotary component of the latch mechanism is disposed on a top surface of the tang.

10. The tool of claim 8, further comprising one or more beveled surfaces on the protrusion, the beveled surfaces configured for urging the latch mechanism between the first and second positions by engagement with a surface of the tool holder when the second end of the tool body is inserted therein, and further wherein the protrusion engages with the recess in the tool holder when the second end of the tool body is fully inserted.

11. A press brake tool comprising:

a tool body having a working end configured for operation on a workpiece and a coupling end configured for coupling the tool body to a tool holder;

a shoulder configured for transmission of a load from the tool holder through the tool body to the working end; and an engagement mechanism adapted for selective engagement of the tool body with the tool holder, the engagement mechanism comprising:

a rotary latch configured to engage the coupling end of the tool body with the tool holder in a locked position and to disengage the coupling end of the tool body from the tool holder in an unlocked position;

a shaft rotationally coupled to the rotary latch; and an actuator member coupled to the shaft, whereby the actuator member is configured to rotate the rotary latch between the locked and unlocked positions to selectively engage and disengage the tool body from the tool holder, respectively.

12. The press brake tool of claim 11, wherein the rotary latch comprises a protrusion coupled to the shaft and configured to rotate outward from the coupling end of the tool body for engaging a recess in the tool holder in the locked position and to rotate inward toward the coupling end of the tool body to disengage from the recess in the tool holder in the unlocked position.

13. The press brake tool of claim 11, wherein the protrusion extends from a side surface of the coupling end of the tool body in the locked position and the protrusion is disposed within or flush with the side surface of the tool body in the unlocked position.

14. The press brake tool of claim 11, further comprising a biasing member configured to resiliently bias the rotary latch in one or both of the locked and unlocked positions, the biasing member coupled to one or more of the rotary latch, the shaft and the actuator member.

15. The press brake tool of claim 11, wherein the rotary latch is disposed within the tool holder with the coupling end engaged therein, the shaft extending from the rotary latch to the actuator disposed outside the tool holder for access to the engagement mechanism when the tool body is coupled to the tool holder.

16. The press brake tool of claim 15, wherein the shaft extends longitudinally within the tool body from the rotary latch in the coupling end to the actuator, and further comprising an access window disposed in the tool body for access to the actuator.

17. The press brake tool of claim 16, wherein the actuator comprises a handle, lever, knob or protrusion coupled to the shaft and configured for manual access via the window when the coupling end of the tool is engaged within the tool holder.

18. The press brake tool of claim 11, wherein the engagement mechanism comprises:

one or more additional rotary latches configured to engage the coupling end of the tool body with the tool holder in respective locked positions and to disengage the coupling end of the tool body from the tool holder in respective unlocked positions; and an additional shaft rotationally coupled to each additional rotary latch.

19. The press brake tool of claim 18, wherein the actuator member is mechanically coupled to each of the shafts to rotate each rotary latch together between the locked and unlocked positions in order to selectively engage and disengage the tool body from the tool holder.

20. The press brake tool of claim 18, further comprising an additional actuator member coupled to each additional shaft, whereby each actuator member is configured to independently rotate the respective rotary latch between the locked and unlocked positions to selectively engage and disengage the tool body from the tool holder.

21. The press brake tool of claim 20, wherein the actuator members are configured to independently rotate two of the respective rotary latches in different directions, wherein the two respective latches have a substantially mirror image operational configuration.

22. A method of operating the press brake tool of claim 11 with a press brake apparatus, the method comprising inserting the coupling end of the tool body into the tool holder and engaging the rotary latch in the locked position.

* * * * *